US006421038B1

(12) United States Patent
Lee

(10) Patent No.: US 6,421,038 B1
(45) Date of Patent: Jul. 16, 2002

(54) ACTIVE MATRIX LIQUID CRYSTAL DISPLAY

(75) Inventor: Hyun Chang Lee, Anyang (KR)

(73) Assignee: Lg. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/401,921

(22) Filed: Sep. 23, 1999

Related U.S. Application Data

(63) Continuation-in-part of application No. 09/211,677, filed on Dec. 14, 1998.

(30) Foreign Application Priority Data

Sep. 19, 1998 (KR) ..... 98-38842
Jul. 19, 1999 (KR) ..... 99-29144

(51) Int. Cl.[7] ..... G09G 3/36
(52) U.S. Cl. ..... 345/98; 87/92; 87/94; 87/90
(58) Field of Search ..... 345/92, 94, 95, 345/98, 87, 90

(56) References Cited

U.S. PATENT DOCUMENTS

| | | | | |
|---|---|---|---|---|
| 5,457,474 A | | 10/1995 | Ikeda | 345/92 |
| 5,646,643 A | | 7/1997 | Hirai et al. | 345/100 |
| 5,764,225 A | | 6/1998 | Koshobu | 345/211 |
| 6,069,605 A | * | 5/2000 | Ozawa | 345/98 |
| 6,160,533 A | * | 12/2000 | Tamai et al. | 345/89 |

FOREIGN PATENT DOCUMENTS

| | | |
|---|---|---|
| EP | 0320054 | 6/1989 |
| EP | 500354 A3 | 8/1992 |
| EP | 500354 A2 | 8/1992 |
| EP | 508628 A2 | 10/1992 |
| EP | 508628 A3 | 10/1992 |
| EP | 0574920 | 12/1993 |
| EP | 0 657 864 A1 | 6/1994 |
| EP | 657864 A1 | 6/1995 |
| EP | 0 780 825 A1 | 6/1997 |
| JP | 2-272490 | 11/1990 |
| JP | 61-10035 | 4/1994 |

* cited by examiner

*Primary Examiner*—Richard Hjerpe
*Assistant Examiner*—Duc Q. Dinh
(74) *Attorney, Agent, or Firm*—Long Aldridge & Norman LLP

(57) ABSTRACT

A liquid crystal display apparatus that is adaptive for eliminating a flicker and a residual image as well as simplifying the circuit configuration thereof. In the apparatus, a plurality of pixels each includes a switching transistor having a second electrode connected to a gate electrode, a first electrode and a pixel electrode. Each of pluralities of data signal lines is connected to the second electrode associated with any one of the transistors, and each of pluralities of gate signal lines is connected to the gate electrode associated with any one of the transistors. A gate driver is connected to the plurality of gate signal lines, and it receives first and second voltages and outputs any one of the first and second voltages to drive the gate signal lines sequentially. The first voltage changes prior to exciting of successive gate signal lines.

11 Claims, 25 Drawing Sheets

LOW LEVEL GATE VOLTAGE GENERATOR
HIGH LEVEL VOLTAGE GENERATOR
HSDCK
SCL
DCL
GSPGSC
VOLTAGE CONTROLLER
TIMING CONTROLLER
DATA DRIVER
32
46
48
42
CL
FVL
34
GCL
SVL
36
38
SHIFT REGISTER
QT1
QT2
QTn-2
QTn-1
QTn
39
VCC
Cst
31
CMN
Clc
Cp
Rp
GL1
GL2
GLn-2
GLn-1
GLn
SL1
SL2
SL3
SLm-1
SLm
34
30

ACTIVE MATRIX LIQUID CRYSTAL DISPLAY

CROSS-REFERENCE TO RELATED ART

This application claims the benefit of Korean Patent Application No P98-38842, filed on Sep. 19, 1998, which is hereby incorporated by reference.

This is a continuation-in-part of application Ser. No. 09/211,677, filed Dec. 14, 1998.

BACKGROUND OF THE INVENTION

1. Field of the Invention

This invention relates to an active matrix liquid crystal display, and more particularly, to an active matrix liquid crystal display, wherein it is provided with a device for applying a gate pulse to transistors connected to picture elements (or pixels) consisting of a liquid crystal.

2. Description of the Related Art

The conventional active matrix liquid crystal display apparatus displays a picture by controlling the light transmissivity of liquid crystal using an electric field. As shown in FIG. 1, such a liquid crystal display apparatus includes a data driver 12 for driving signal lines SL1 to SLm at a liquid crystal panel 10, and a gate driver 14 for driving gate lines GL1 to GLn at a liquid crystal panel 10. In the liquid crystal panel 10, pixels 11 connected to signal lines SL and gate lines GL are arranged in an active matrix pattern. Each pixel 11 includes a liquid crystal cell C1c for responding to a data voltage signal DVS from the signal line SL to control a transmitted light quantity, and a thin film transistor (TFT) CMN for responding to a scanning signal SCS from the gate line GL to switch the data voltage signal DVS to be applied from the signal line SL to the liquid crystal cell C1c. As the gate lines GL1 to GLn are sequentially driven, the data driver 12 applies the data voltage signal DVS to all the signal lines SL1 to SLm. The gate driver 14 allows the gate lines GL1 to GLn to be sequentially enabled for each horizontal synchronous interval by applying the scanning signal SCS to the gate lines GL1 to GLn sequentially. To this end, the gate driver 14 consists of a shift register 16 responding to a gate start pulse GSP from a control line CL and a gate scanning clock GSC from a gate clock line GCL, and a level shifter 18 connected between the shift register 16 and the gate lines GL1 to GLn. The shift register 16 outputs the gate start pulse GSC from the control line CL to any one of n output terminals QT1 to QTn and, at the same time, responds to the gate scanning clock GSC to shift the gate start pulse GSP from the first output terminal QT1 to the nth output terminal QTn sequentially. The level shifter 18 generates n scanning signals SCS by shifting voltage levels of the output signals of the shift register 16. To this end, the level shifter 18 consists of n inverters 19 that are connected between the n output terminal QT1 to QTn the shift register 16 and the n gate lines GL1 to GLn, respectively, and fed with low and high level gate voltages Vgl and Vgh in a direct current shape from a first and a second voltage line FVL and SVL, respectively. The inverters 19 selectively supply any one of the low and high level gate voltages Vg1 and Vgh to the gate line GL in accordance with a logical state at the output terminal QT of the shift register 16. Accordingly, only one of the n scanning signals SCS has the high level gate voltage Vgh.

In this case, the TFT CMN receiving a scanning signal SCS having the high level gate voltage Vgh from the gate line GL is turned on, and the liquid crystal cell C1c charges the data voltage signal DVS during an interval when the TFT CMN is turned on. The voltage charged into the liquid crystal cell C1c in this manner drops down when the TFT CMN is turned off and therefore becomes lower than a voltage of the data voltage signal DVS. Accordingly, a feed through voltage Vp corresponding to a difference of voltage between the voltage charged in the liquid crystal cell and the data voltage signal DVS, is generated. This feed through voltage )Vp is caused by a parasitic capacitance existing between the gate terminal of the TFT CMN and the liquid crystal cell C1c, which changes a transmitted light quantity at the liquid crystal cell C1c periodically. As a result, a flicker and a residual image are generated at a picture displayed on the liquid crystal panel.

In order to suppress such a feed through voltage )Vp, as shown in FIG. 1, support capacitors Cst are connected, in parallel, to the liquid crystal cells. The support capacitor Cst compensates for the liquid crystal cell voltage when the TFT CMN is turned off, thereby suppressing the feed through voltage )Vp as expressed in the following formula:

$$Vp=(Von-Voff)\cdot Cgs/C1c+Cst+Cgs \quad (1)$$

in which Von represents a voltage at the gate line GL upon turning on of the TFT CMS; Voff represents a voltage at the gate line GL upon turning off of the TFT CMS; and Cgs represents a capacitance value of a parasitic capacitor existing between the gate terminal of the TFT CMN and the liquid crystal cell. As seen from formula (1), the feed through voltage )Vp increases depending on a voltage difference at the gate line GL upon turning on and turning off of the TFT CMN.

In order to sufficiently suppress the feed through voltage )Vp, a capacitance value of the support capacitor Cst must be increased. This causes aperture ratio of display area to be decreased, so that it is impossible to obtain a sufficient display contrast. As a result, it is difficult to suppress the feed through voltage )Vp sufficiently by means of the support capacitor Cst.

As another alternative for suppressing the feed through voltage )Vp, there has been suggested a liquid crystal display apparatus adopting a scanning signal control system for allowing the falling edge of the scanning signal SCS to have a gentle slope. In the liquid crystal display apparatus of a scanning signal control system, the falling edge of the scanning signal SCS changes in the shape of a linear function as shown in FIG. 2A, an exponential function as shown in FIG. 2B, or a ramp function as shown in FIG. 2C. Examples of such a liquid crystal display apparatus of scanning signal control system are disclosed in the Japanese Patent Laid-Open Gazette Nos. 1994-110035 and 1997-258174 and the U.S. Pat. No. 5,587,722. However, these liquid crystal display devices of a scanning signal control system additionally require a circuit modification of the gate driver or a new waveform modifying circuit to be positioned between the gate driver and each gate line at the liquid crystal panel. The gate driver described in the U.S. Pat. No. 5,587,722 has a complex circuitry and consumes a great amount of power, because a circuit allowing the falling edge of the scanning signal to be stepwise is formed in a gate driver chip.

For example, as shown in FIG. 3, the liquid crystal display apparatus of a scanning signal control system disclosed in the Japanese Patent Laid-Open Gazette No. 1994-110035 includes an integrator 22 connected between a scanning driver cell 20 and a gate line GL. The integrator 22 consists of a resistor R1 between the scanning driver cell 20 and the gate line GL, and a capacitor C1 connected between the gate line GL and the ground voltage line GVL. The integrator 22 integrates a scanning signal SCS to be applied from the gate driver cell 20 to the gate line GL, thereby changing the falling edge of the scanning signal SCS into a shape of exponential function. A TFT CMN included in a pixel 11 is turned on until a voltage of the scanning signal SCS from the gate line GL drops less than its threshold voltage. At this time, an electric charge charged in a liquid crystal cell C1c is pumped into the gate line GL through Cgs. However, sufficient electric charge is charged into the liquid crystal cell C1c by means of a data voltage signal DVS passing through the TFT CMN from a signal line SL. As a result, the voltage charged in the liquid crystal cell C1c does not drop. Then, since a voltage variation amount in the gate line GL is a maximum threshold voltage of the TFT CMN when a voltage of the scanning signal SGS at the gate line GL drops less than a threshold voltage of the TFT CMN, electric charge amount pumped from the liquid crystal cell C1c into the gate line GL becomes very small. As a result, the feed through voltage )Vp can be suppressed sufficiently.

In the liquid crystal display apparatus of a scanning signal control system as described above, since the feed through voltage )Vp is sufficiently suppressed to reduce a flicker and a residual image considerably but a waveform modifying circuit, such as an integrator, for each gate line must be added, the circuit configuration thereof becomes very complex. Further, because the rising edge of the scanning signal also changes slowly due to the waveform modifying circuit, a charge initiation time at the liquid crystal cell is delayed.

Meanwhile, the U.S. Pat. No. 5,587,722 discloses a shift register 3 selectively receiving power supply voltages VVDD and VVDD·R1/(R1+R2), as shown in FIG. 4. The shift register 3 responds to the supply voltages VVDD and VVDD·R1/(R1+R2) and generates a stepwise pulse. However, the shift register 3 must be driven at a high voltage because the supply voltage VVDD is equal to a high-level gate voltage to be applied to gate lines on the liquid crystal display panel. In other words, inverters 5, 6 and 9 included in the shift register 3 operate at about 25 V of the driving voltage, if maximum voltage for turning on the TFT is a voltage of 2.5. Due to this, the active matrix liquid crystal display apparatus, disclosed in U.S. Pat. No. 5,587,722, consumes a large amount of power.

SUMMARY OF THE INVENTION

Accordingly, it is an object of the present invention to provide a liquid crystal display apparatus and method that is adapted to eliminate flickering and residual images as well as to simplify the circuit configuration thereof.

Additional features and advantages of the invention will be set forth in the description which follows and, in part, will be apparent from the description, or may be learned by practice of the invention. The objectives and other advantages of the invention will be realized and attained by the structure particularly pointed out in the written description and claims hereof as well as the appended drawings.

In order to achieve this and other objects of the invention, a liquid crystal display apparatus according to one embodiment of the present invention includes a plurality of pixels including switching transistors, each switching transistor having an electrode connected to a pixel electrode and a gate electrode; a plurality of data signal lines connected to the electrode associated with any one of the transistors; a plurality of gate signal lines connected to the gate electrode associated with any one of the transistors; and a gate driver connected to the plurality of gate signal lines. The gate driver receives first and second voltages and outputting at least one of the first and second voltages in such a manner to sequentially drive the gate signal lines, the first voltage changing prior to driving successive gate signal lines. The gate driver includes a shift register for generating scanning signals to be applied respectively to the gate lines, wherein the shift register is responsive to a gate scanning clock; a level shifter making use of the first and second voltages to generate each voltage level of the scanning signals; and a voltage controller for changing the first voltage applied to the level shifter prior to disabling of the scanning signals. Preferably, a minimum value of the first voltage is higher than a maximum value of the second voltage.

According to one aspect of the present invention, the first voltage decreases prior to driving of the successive gate signal lines. In particular, the first voltage decreases exponentially, linearly or stepwisely.

According to another aspect of the present invention, the voltage controller includes a switch for cutting off the first voltage applied to the level shifter prior to disabling of the scanning signal; and a discharging path provided to the level shifter during period in which the scanning signal is cut off by means of the switch. The switch and the shift register respond to the gate scanning clock. The voltage controller may also include a timing controller for controlling the switch.

Alternatively, the voltage controller includes an input terminal for receiving the first voltage; a first resistor connected between the input terminal and an input port of the level shifter; a first control switch and a second resistor connected in series between the input port of the level shifter and a ground voltage line; and a second control switch connected in parallel to the first resistor, the second control switch being driven alternatively with the first control switch.

According to another aspect of the present invention, the voltage controller comprises a switch responsive to a gate output enable signal and is connected between the first voltage and the level shifter. Preferably, the gate output enable signal is inverse of the gate scanning clock.

A method of driving a liquid crystal display apparatus according to another aspect of the present invention includes the steps of inputting a first voltage and a periodically changing second voltage; supplying the second voltage, via a switching device, to the gate line; and supplying the first voltage, via the switching device, to the gate line, the switching device being controlled by the shift register, wherein a minimum value of the second voltage is higher than a maximum value of the first voltage.

It is to be understood that both the foregoing general description and the following detailed description are exemplary and explanatory and are intended to provide further explanation of the invention as claimed.

BRIEF DESCRIPTION OF THE DRAWINGS

These and other objects of the invention will be apparent from the following, detailed description of the embodiments of the present invention with reference to the accompanying drawings, in which.

DETAILED DESCRIPTION OF THE PREFERRED EMBODIMENTS

Figure 1:
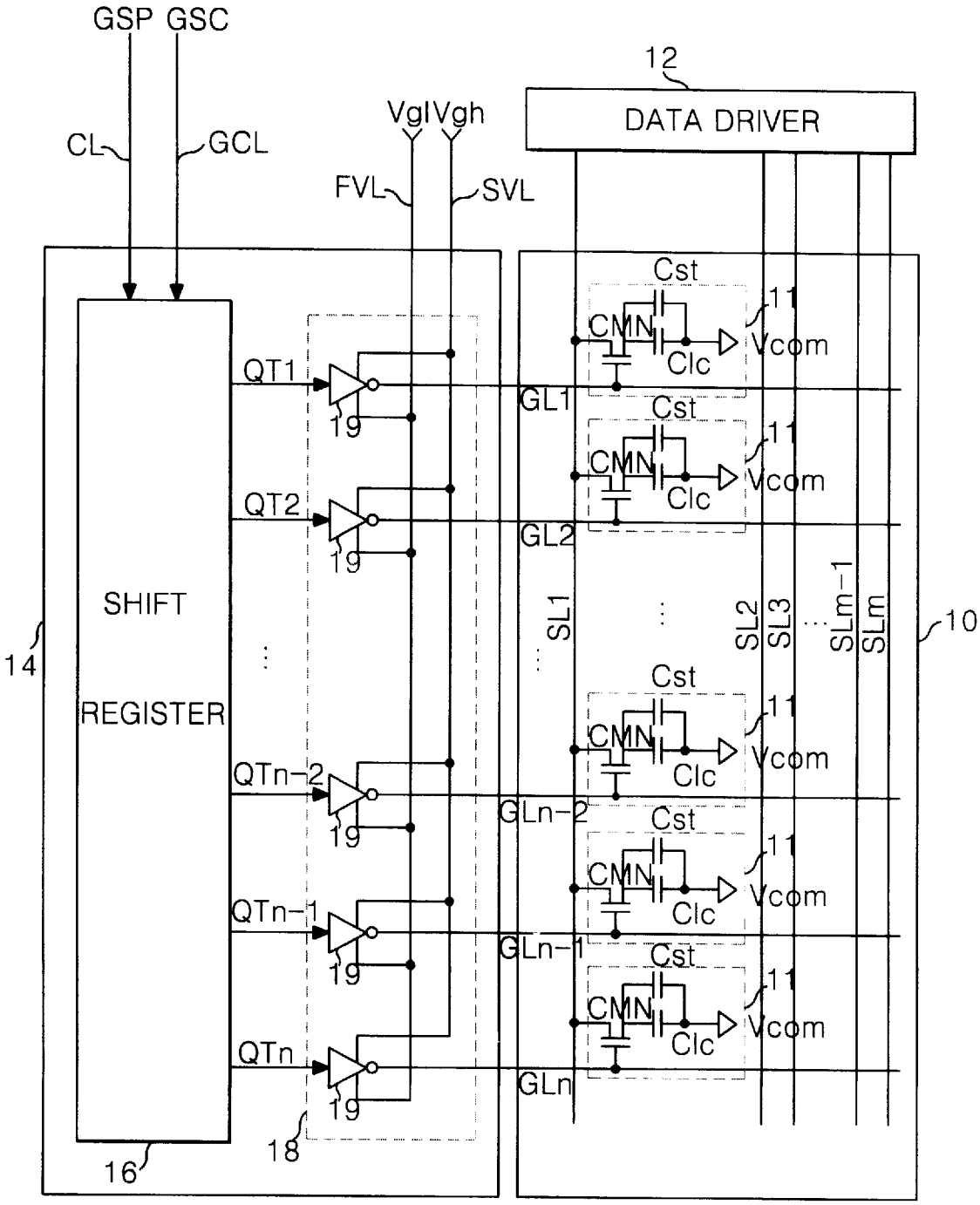
FIG.1 PRIOR ART
FIG. 1 is a schematic view showing the configuration of a prior liquid crystal display device.
Figure 2A:
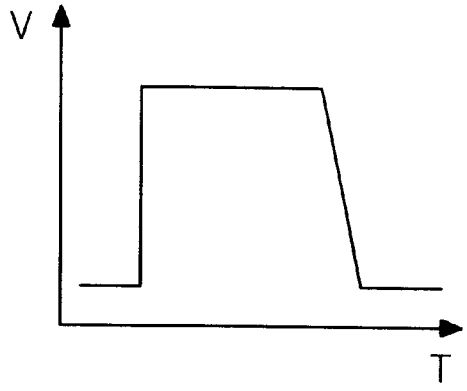
FIG. 2A PRIOR ART
FIGS. 2A to 2C are waveform diagrams of a scanning signal having the falling edge changed slowly.
Figure 2B:
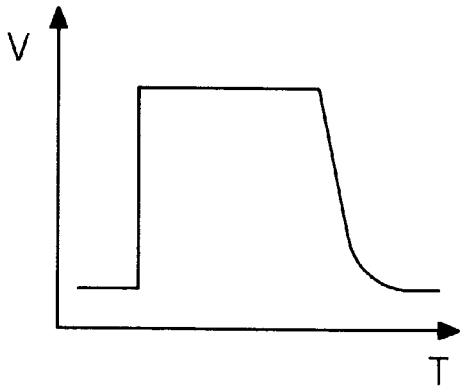
FIG. 2B PRIOR ART
Figure 2C:
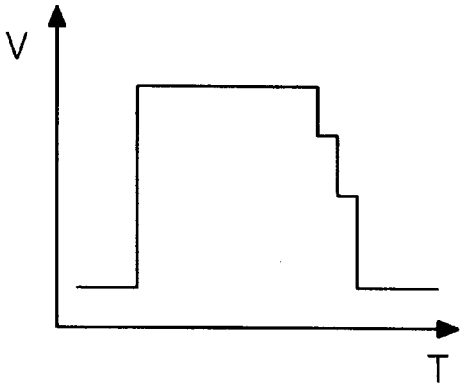
FIG. 2C PRIOR ART
Figure 3:
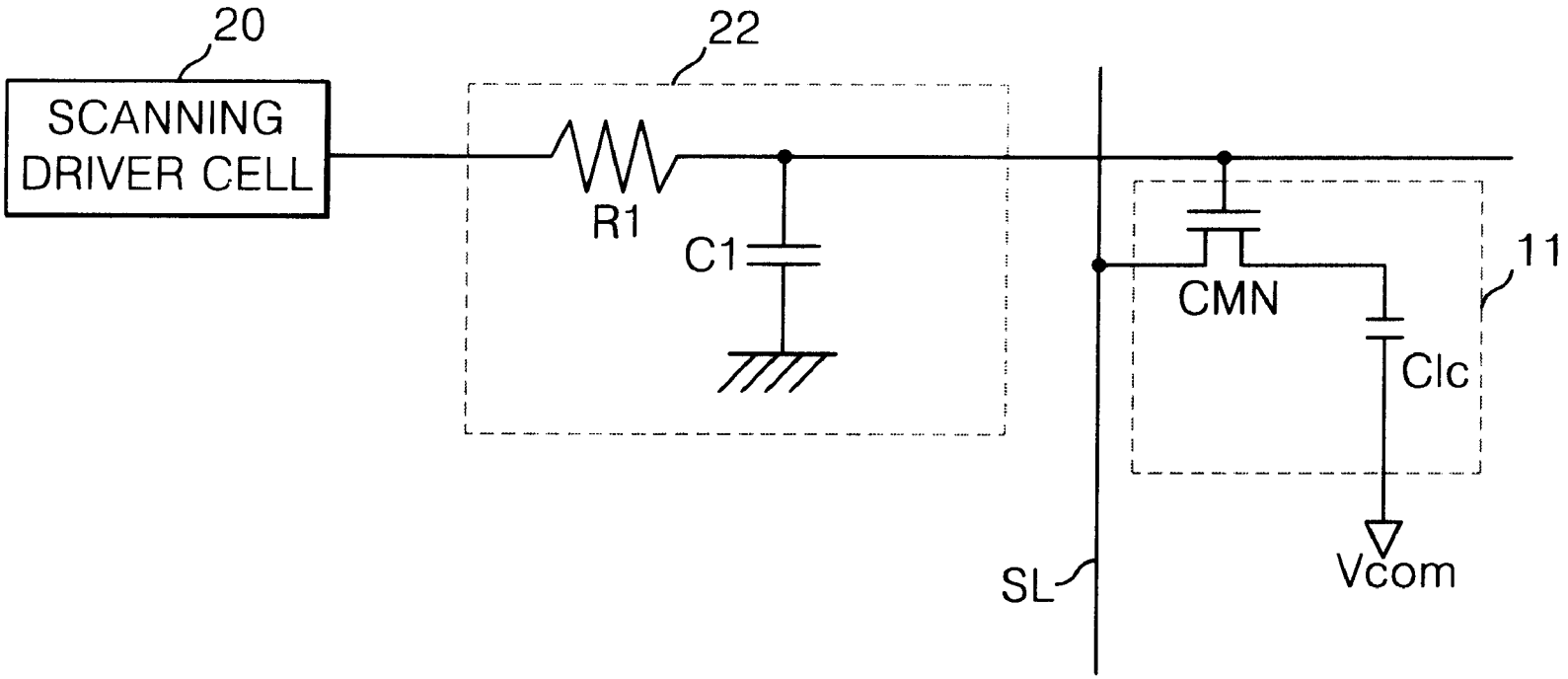
FIG. 3 PRIOR ART
FIG. 3 shows a prior liquid crystal display apparatus employing the scanning signal of FIG. 2B.
Figure 4:
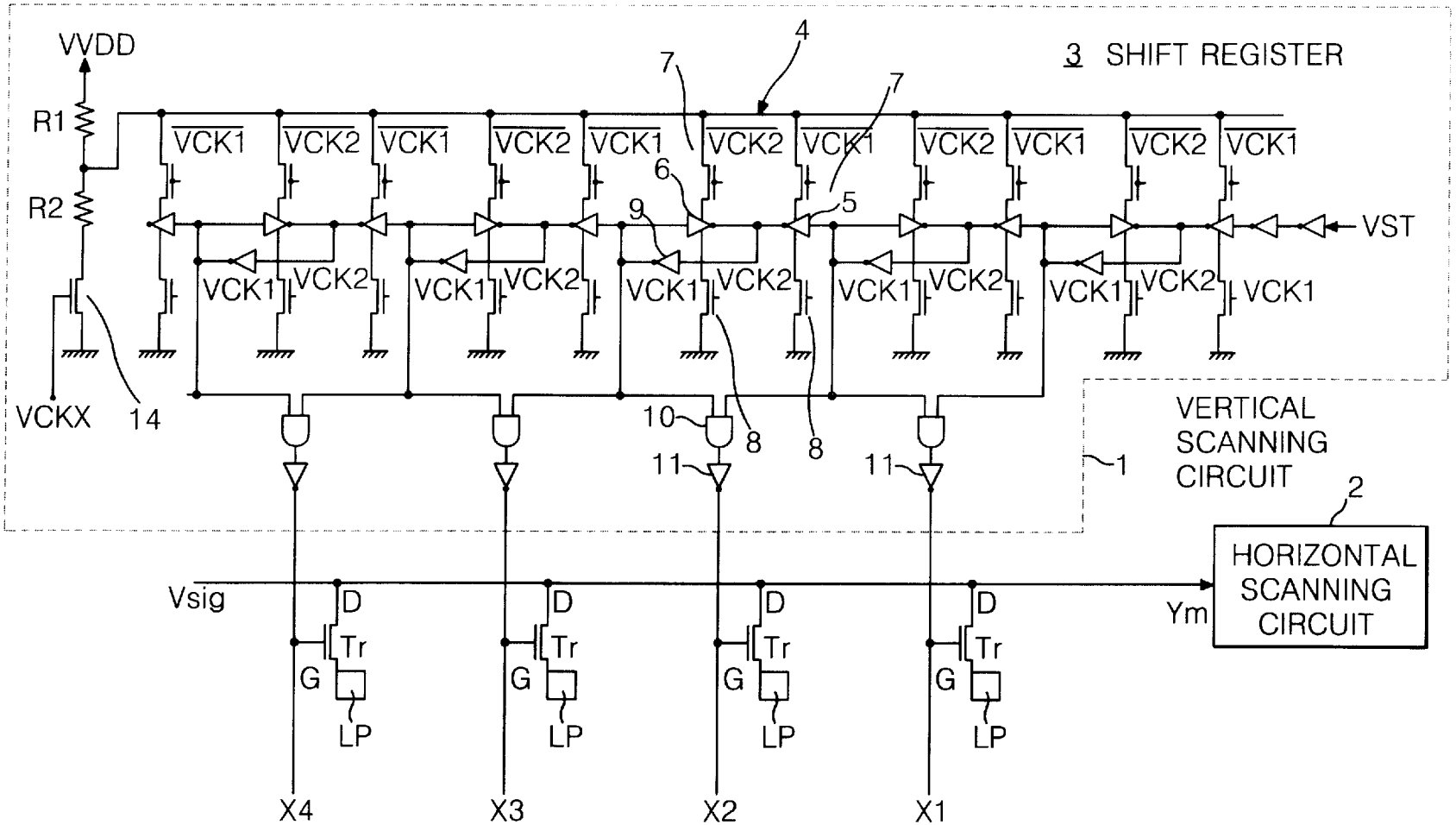
FIG. 4 PRIOR ART
FIG. 4 is a schematic diagram showing the configuration of a prior liquid crystal display apparatus.
Figure 5:
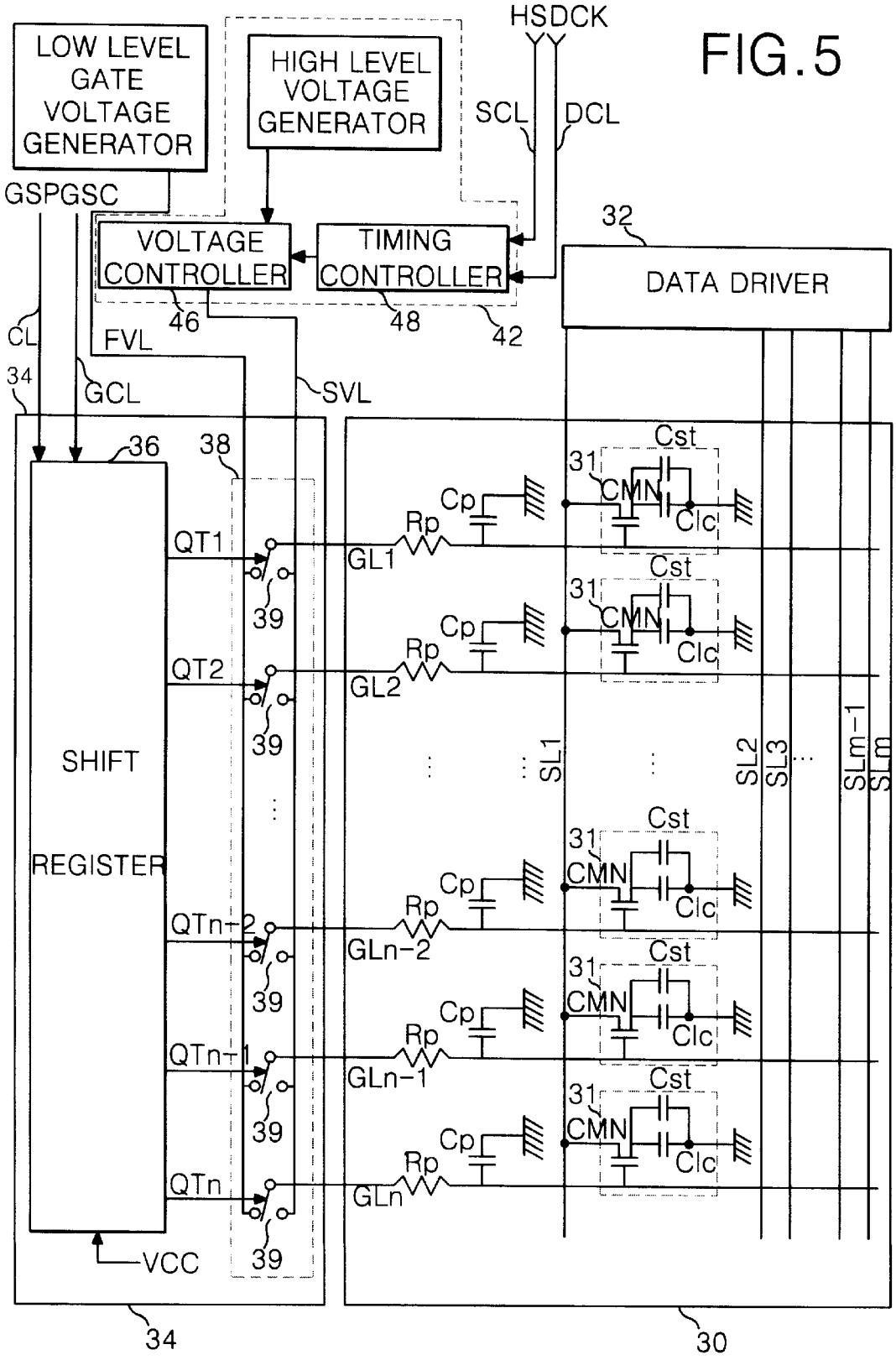
FIG. 5 is a schematic diagram showing the configuration of a liquid crystal display apparatus according to a first embodiment of the present invention.

Referring to FIG. 5, there is shown a liquid crystal display apparatus according to a first embodiment of the present invention that includes a data driver 32 for driving signal lines SL1 to SLm on a liquid crystal panel 30, and a gate driver 34 for driving gate lines GL1 to GLn on the liquid crystal panel 30. In the liquid crystal panel 30, pixels 31 connected to signal lines SL and gate lines GL are arranged in an active matrix pattern. Each pixel 31 includes a liquid crystal cell C1c for responding to a data voltage signal DVS from the signal line SL to control a transmitted light quantity, and a thin film transistor (TFT) CMN for responding to a scanning signal SCS from the gate line GL to switch the data voltage signal DVS to be applied from the signal line SL to the liquid crystal cell C1c. Also, each pixel 31 has a support capacitor Cst connected, in parallel, to the liquid crystal cell C1c. This support capacitor Cst serves to buffer a voltage charged in the liquid crystal cell C1c. As the gate lines GL1 to GLn are sequentially driven, the data driver 32 applies the data voltage signal DVS to all the signal lines SL1 to SLm. The gate driver 34 allows the gate lines GL1 to GLn to be sequentially enabled for each horizontal synchronous interval by applying the scanning signal SCS to the gate lines GL1 to GLn sequentially.

The gate driver 34 has a shift register 36 responding to a gate start pulse GSP from a control line CL and a gate scanning clock GSC from a gate clock line GCL, and further has a level shifter 38 connected between the shift register 36 and the gate lines GL1 to GLn. The shift register 36 outputs the gate start pulse GSP from the control line CL to one of n output terminals QT1 to QTn and, at the same time, responds to the gate scanning clock GSC to shift the gate start pulse GSP from the first output terminal QT1 to the nth output terminal QTn sequentially. Also, the shift register 36 operates at an integrated circuit driving voltage VCC having 5 V corresponding to a logical voltage level.

The level shifter 38 generates n scanning signals SCS by shifting voltage levels of the output signals of the shift register 36. To this end, the level shifter 38 includes n control switches 39 connected between the n output terminal QT1 to QTn of the shift register 36 and the n gate lines GL, respectively, to switch low and high level gate voltages Vg1 and Vgh from first and second voltage lines FVL and SVL, respectively. The control switch 39 selectively delivers any one of the low and high level gate voltages Vg1 and Vgh to the gate line GL in accordance with a logical state at the output terminal QT of the shift register 36. Accordingly, only one of the n scanning signals SCS has the high level gate voltage Vgh. In this case, the TFT CMN at the gate line GL supplied with the high level gate voltage Vgh is turned on and thus the liquid crystal cell C1c charges the data voltage signal DVS during an interval when the TFT CMN is turned on. Each control switch 39 may be replaced by a buffer in which the low and high level gate voltages Vg1 and Vgh are its operation voltage.

The liquid crystal display apparatus according to the first embodiment of the present invention further includes a low level gate voltage generator 40 connected to the first voltage line FVL and a high level gate voltage generator 42. The low level gate voltage generator 40 generates a low level gate voltage Vg1 maintaining a constant voltage level or alternating periodically and supplies it to the n control switches 39 connected to the first voltage line FVL. The low level gate voltage Vg1 generated at the low level voltage generator 40 may have a shape of an alternating current signal, such as a certain period of pulse signal.

The high level gate voltage generator 42 generates a high level gate voltage Vgh, changing in a predetermined shape every period of horizontal synchronous signal, such as an alternating current signal. The high level gate voltage Vgh has a falling edge, changing slowly. The falling edge of the high level gate voltage Vgh is changed into the shape of a linear function, an exponential function, or a ramp function.

In order to generate such a high level gate voltage Vgh, the high level gate voltage generator 42 includes a high level voltage generator 44 for generating a high level voltage, a voltage controller 46 connected between the high level voltage generator 44 and the second voltage line SVL, and a timing controller 48 for controlling a level control time of the voltage controller 46. The high level voltage generator 44 supplies a high level voltage VDD in the shape of direct current, maintaining a constant voltage level stably to the voltage controller 46. The voltage controller 46 periodically delivers the high level voltage VDD to the n control switches 39 connected to the second voltage line SVL and, at the same time, allows a voltage supplied to the second voltage line SVL to be lowered into any one of the function shapes mentioned above.

In order to change the falling edge of the voltage signal at the second voltage line SVL slowly, the voltage controller 46 may make use of a parasitic resistor Rp and a parasitic capacitor Cp existing in the gate lines GL of the liquid crystal panel 30. The timing controller 48 responds to a horizontal synchronous signal HS from a synchronization signal line SCL and a data clock DCLK from a data clock line DCL to determine a voltage switching time and a voltage control time of the voltage controller 46. To this end, the timing controller 48 may include a counter that is initialized by the horizontal synchronous signal HS and counts the data clock DCLK, and a logical combiner (not shown) for logically combining output signals of the counter to control the voltage controller 46.

As described above, since the high level gate voltage Vgh at the second voltage line SVL has a falling edge changing into the alternating current shape and decreasing slowly, the falling edge of the scanning signal SCS applied to the gate line GL of the liquid crystal panel 30 changes slowly. The TFT CMN included in the pixel 31 is turned on until a voltage of the scanning signal SCS from the gate line GL drops less than its threshold voltage. At this time, electric charge stored in a liquid crystal cell C1c is pumped into the gate line GL, but sufficient electric charge is charged into the liquid crystal cell C1c by means of a data voltage signal DVS passing through the TFT CMN from a signal line SL. Accordingly, the voltage charged in the liquid crystal cell C1c does not drop. Then, since a voltage variation amount in the gate line GL is a maximum threshold voltage of the TFT CMN when a voltage of the scanning signal SCS at the gate line GL drops less than a threshold voltage of the TFT CMN, electric charge amount pumped from the liquid crystal cell C1c into the gate line GL becomes very small. As a result, a feed through voltage )Vp can be suppressed sufficiently.

Figure 6:
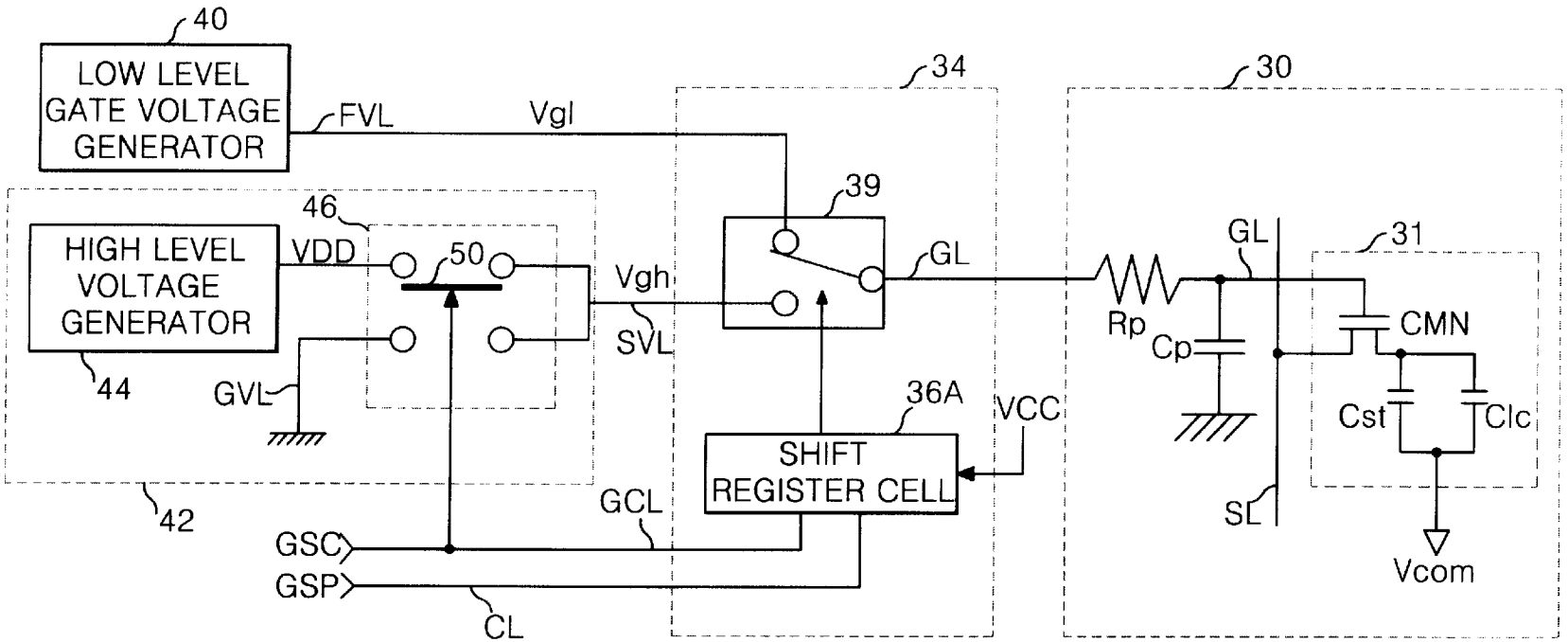
FIG. 6 is a schematic diagram showing the configuration of a liquid crystal display apparatus according to a second embodiment of the present invention.

Referring now to FIG. 6, there is shown a liquid crystal display apparatus according to a second embodiment of the present invention. In the liquid crystal display apparatus of FIG. 6, a voltage controller 46 makes use of a parasitic resistor Rp and a parasitic capacitor Cp at a gate line GL to change the falling edge of a high level gate voltage Vgh and the falling edge of a scanning signal SCS into an exponential function shape. The liquid crystal display apparatus of FIG. 6 has a gate driver 34 for driving a gate line GL on a liquid crystal panel 30. The liquid crystal panel 30 includes a pixel 31 connected to a signal line SL and the gate line GL. The pixel 31 includes a liquid crystal cell C1c for responding to a data voltage signal DVS from the signal line SL to control a transmitted light quantity, and a TFT CMN for responding to a scanning signal SCS from the gate line GL to switch the data voltage signal DVS to be applied from the signal line SL to the liquid crystal cell C1c. Also, the pixel 31 has a support capacitor Cst connected, in parallel, to the liquid crystal cell C1c.

Figure 7:
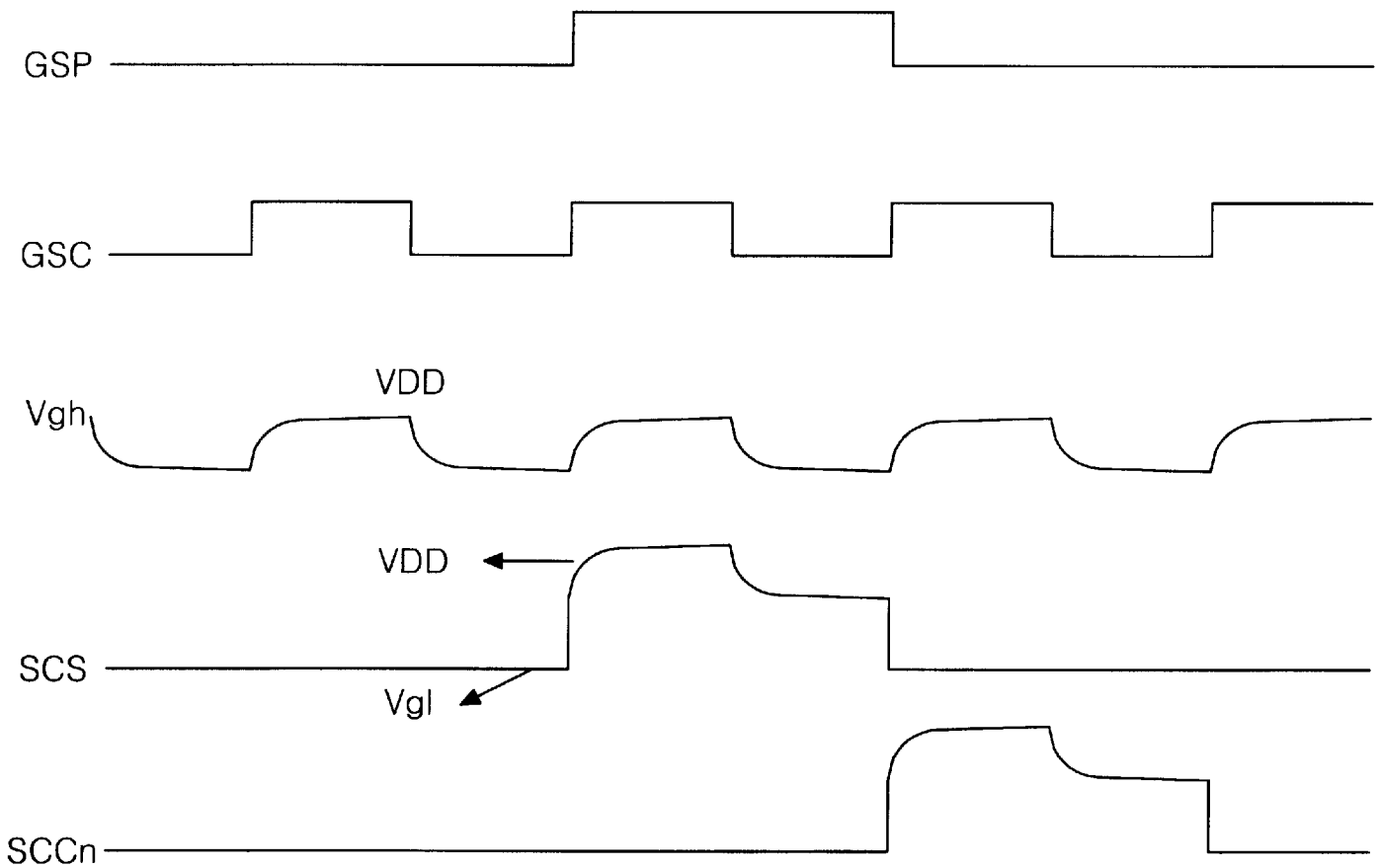
FIG. 7 is output waveform diagrams of each part of the liquid crystal display apparatus shown in FIG. 6.

In the second embodiment, the gate driver 34 consists of a shift register cell 36A responding to a gate start pulse GSP from a control line CL and a gate scanning clock GSC from a gate clock line GCL, and a control switch 39 connected between the shift register cell 36A and the gate line GL. The shift register cell 36A outputs the gate start pulse GSP at the rising edge of the gate scanning clock GSC as shown in FIG. 7 to an output terminal QT. The control switch 39 selectively delivers one of the low and high level gate voltages Vg1 and Vgh to the gate line GL in accordance with a logical state at the output terminal QT of the shift register cell 36A.

Accordingly, a scanning signal SCS, having the low level gate voltage Vg1 or the high level gate voltage Vgh, emerges at the gate line GL. More specifically, the control switch 39 allows the high level gate voltage Vgh to be supplied to the gate line GL when an output signal of the shift register cell 36A has a high logic; while it allows the low level gate voltage Vg1 to be supplied to the gate line GL when an output signal of the shift register cell 36A has a low logic. A signal "SCSn" in FIG. 7 represents a waveform of a scanning signal applied to the next gate line.

The liquid crystal display apparatus according to the second embodiment of the present invention further includes a low level gate voltage generator 40 connected to the first voltage line FVL and a high level gate voltage generator 42. The low level gate voltage generator 40 generates a low level gate voltage Vg1 maintaining a constant voltage level and supplies it to the control switch 39 connected to the first voltage line FVL. The high level gate voltage generator 42 generates a high level gate voltage Vgh, changing periodically as shown in FIG. 7. The falling edge of the high level gate voltage Vgh drops slowly in an exponential function shape. In order to generate such a high level gate voltage Vgh, the high level gate voltage generator 42 includes a high level voltage generator 44 for generating a high level voltage VDD and a voltage controller 46 connected between the high level voltage generator 44 and the second voltage line SVL.

The high level voltage generator 44 supplies a high level voltage VDD in the shape of direct current maintaining a constant voltage level stably to the voltage controller 46. The voltage controller 46 alternately couples the second voltage line SVL with the high level voltage generator 44 and the ground voltage line GVL, thereby generating the high level gate voltage Vgh as shown in FIG. 7 at the second voltage line SVL. To this end, the voltage controller 46 includes a two-contact control switch 50 for responding to a gate scanning clock GSC. The two-contact control switch 50 connects the second voltage line SVL to the high level voltage generator 44 at a high logic region of the gate scanning clock GSC, so that a high level voltage VDD emerges at the second voltage line SVL and the gate line GL.

When the gate scanning clock GSC transits from a high logic into a low logic, the two-contact control switch 50 connects the second voltage line SVL to a ground voltage line GVL, thereby dropping a voltage at the second voltage line SVL and the gate line GL from the high level VDD in the exponential function shape. At this time, the voltage at the second voltage line SVL and the gate line GL is discharged into the ground voltage line in accordance with a time constant of the parasitic resistor Rp and the parasitic capacitor Cp, thereby slowly changing the falling edges of the high level gate voltage Vgh and the scanning signal SCS in an exponential function shape as shown in FIG. 7.

Accordingly, the TFT CMN included in the pixel 31 is turned on until a voltage of the scanning signal SCS from the gate line GL drops less than its threshold voltage. At this time, an electric charge charged in a liquid crystal cell C1c is pumped into the gate line GL. but a sufficient electric charge is charged into the liquid crystal cell C1c by means of a data voltage signal DVS passing through the TFT CMN from a signal line SL. Accordingly, the voltage charged in the liquid crystal cell C1c does not drop. Then, since a voltage variation amount in the gate line GL is a maximum threshold voltage of the TFT CMN when a voltage of the scanning signal SCS at the gate line GL drops less than a threshold voltage of the TFT CMN, electric: charge amount pumped from the liquid crystal cell C1c into the gate line GL becomes very small. As a result, a feed through voltage )Vp can be suppressed sufficiently. Furthermore, a flicker and a residual image do not appear at a picture displayed with the pixel 31.

Figure 8:
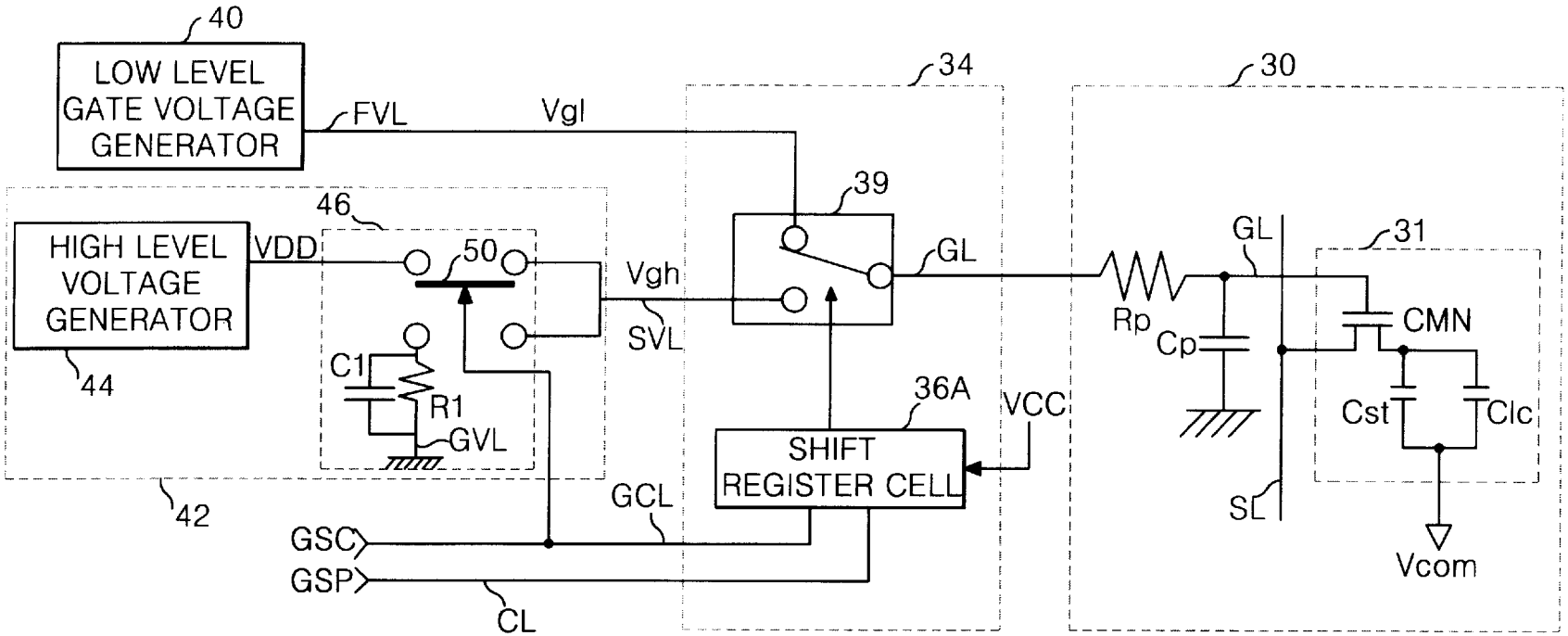
FIG. 8 is a schematic diagram showing the configuration of a liquid crystal display apparatus according to a third embodiment of the present invention.
Figure 9:
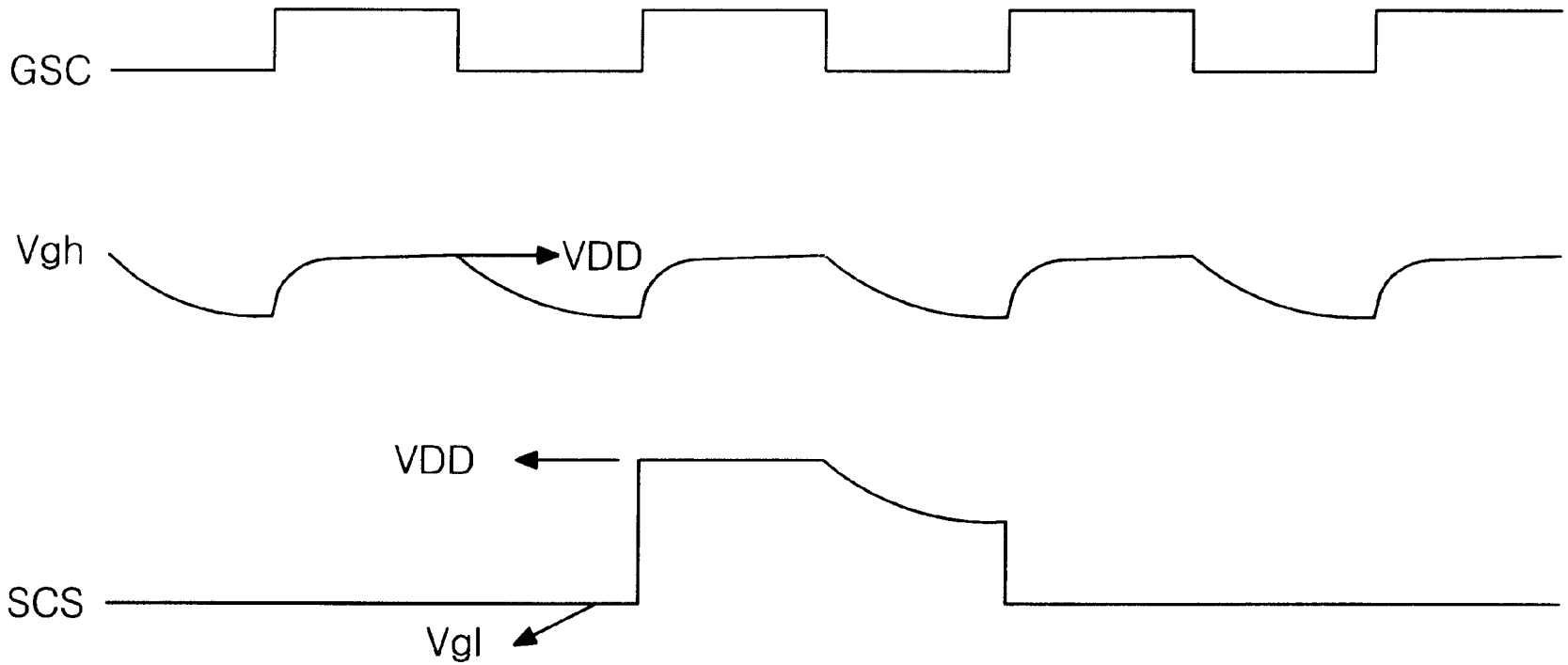
FIG. 9 is waveform diagrams of a high level gate voltage and a scanning signal.

FIG. 8 shows a liquid crystal display apparatus according to a third embodiment of the present invention. The liquid crystal display apparatus of FIG. 8 has a circuit configuration similar to that of FIG. 6, except that a voltage controller 46 further includes a parallel connection of a resister R1 and a capacitor C1 between the two-contact control switch 50 and the ground voltage line GVL. The resistor R1 and the capacitor C1 increases a time constant when a voltage at a second voltage line SVL and a gate line GL is discharged into the ground voltage line GVL. Accordingly, the falling edge of a high level gate voltage Vgh at the second voltage line SVL has a slower slope than the rising edge thereof as shown in FIG. 9. Only one of resistor R1 and capacitor C1 may be used as needed. The falling edges of the high level gate voltage Vgh and the scanning signal SCS are controlled more slowly than the rising edges thereof as described above, so that the liquid crystal display apparatus can suppress a feed through voltage )Vp sufficiently and have a rapid response speed.

Figure 10:
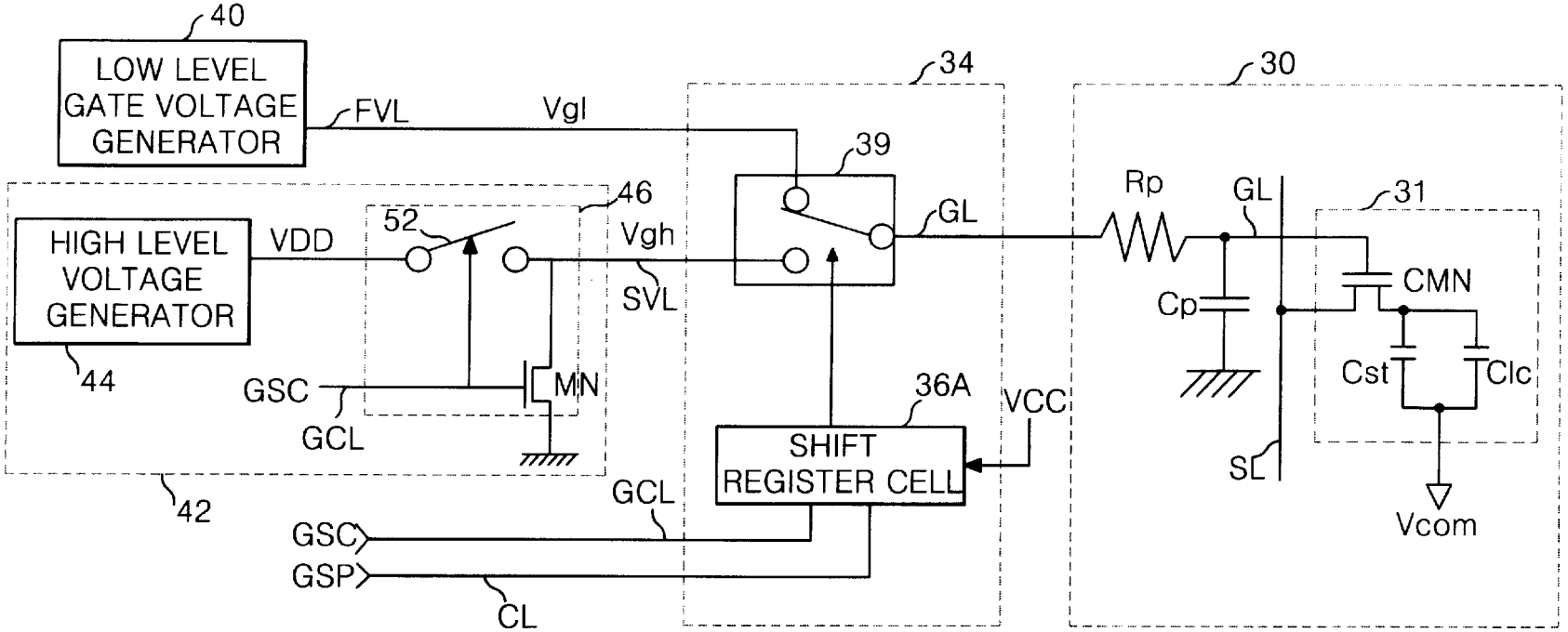
FIG. 10 is a schematic diagram showing the configuration of a liquid crystal display apparatus according to a fourth embodiment of the present invention.

Referring now to FIG. 10, there is shown a liquid crystal display apparatus according to a fourth embodiment of the present invention. The liquid crystal display apparatus of FIG. 10 has a circuit configuration similar to that of FIG. 6, except that a voltage controller 46 further includes a one-contact control switch 52 connected between the high level voltage generator 44 and the second voltage line SVL instead of the two-contact control switch 50, and a TFT MN connected between the second voltage line SVL and the ground voltage line GVL. The one-contact control switch 52 and the TFT MN is complementarily turned on in accordance with a logical state of a gate scanning clock GSC. More specifically, the one-contact control switch 52 is turned on during an interval when the gate scanning clock GSC remains at a high logic, while the TFT MN is turned on during an interval when the gate scanning clock GSC remains at a low logic.

The TFT MN provides a discharge path to the second voltage line SVL and the gate line GL with the aid of the gate scanning clock GSC, thereby changing the falling edges of the high level gate voltage Vgh and the scanning signal SCS into an exponential function shape. Also, the TFT MN increases a time constant with the aid of a resistor component and a capacitor component occurring upon its turning on, when voltages at a second voltage line SVL and a gate line GL are discharged into the ground voltage line GVL. Accordingly, the falling edge of the high level gate voltage Vgh at the second voltage line SVL has a slower slope than the rising edge thereof as shown in FIG. 9. Also, the falling edge of the scanning signal SCS at the gate line GL changes more slowly than the rising thereof as shown in FIG. 9. The falling edges of the high level gate voltage Vgh and the scanning signal SCS are controlled more slowly than the rising edges thereof as described above, so that the liquid crystal display apparatus can suppress a feed through voltage )Vp sufficiently and have a rapid response speed.

The TFT MN has a suitable channel width in such a manner that a resistance value of the resistor component and a capacitance value of the capacitor component are set appropriately. Furthermore, a resistor and/or a capacitor for slightly increasing a time constant may be added between the TFT MN and the ground voltage line GVL.

Figure 11:
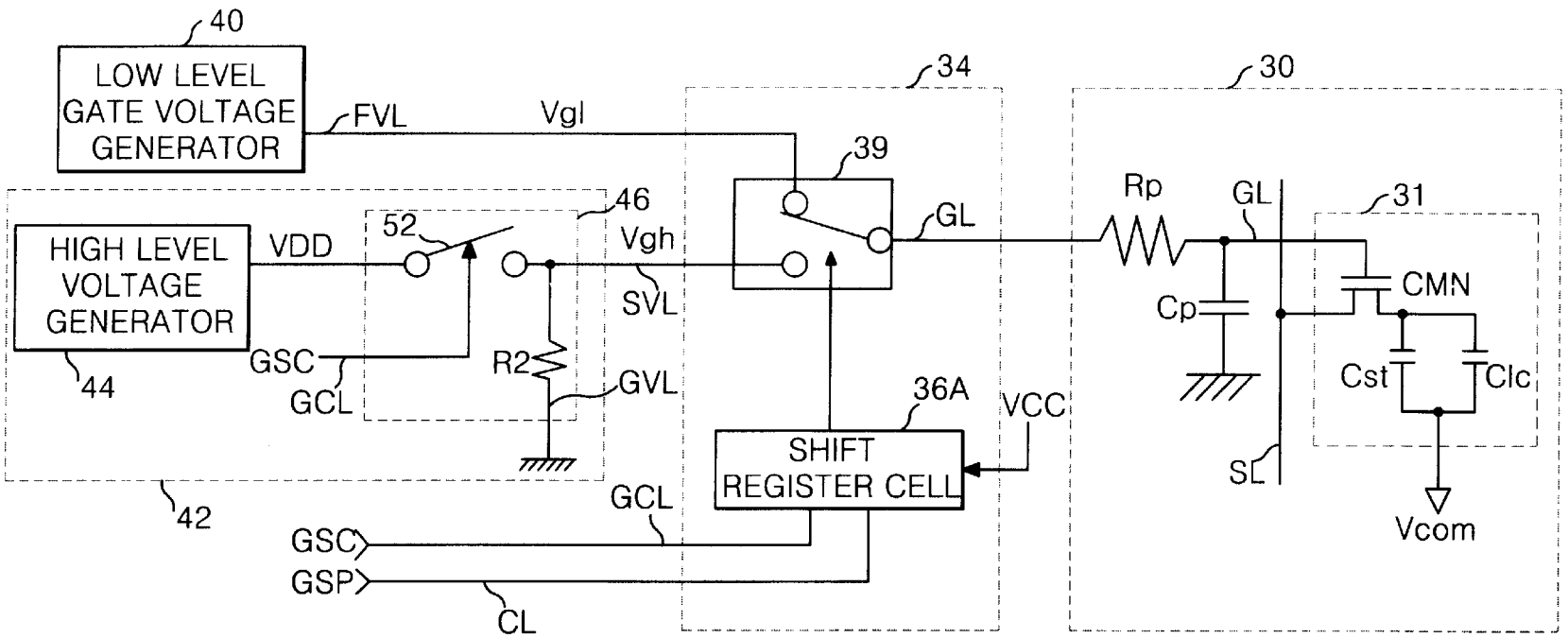
FIG. 11 is a schematic diagram showing the configuration of a liquid crystal display apparatus according to a fifth embodiment of the present invention.

FIG. 11 shows a liquid crystal display apparatus according to a fifth embodiment of the present invention. The liquid crystal display apparatus of FIG. 11 has a circuit configuration similar to that of FIG. 10, except that a resistor R2, instead of the TFT MN, is connected between the second voltage line SVL and the ground voltage line GVL. When a one-contact control switch 52 is turned on with the aid of a high logic of a gate scanning clock GSC, the resistor R2 prevents a leakage of voltage to be charged in the second voltage line SVL and a gate line GL. Otherwise, when the one-contact control switch 52 is turned off, the resistor R2 lengthens a time when voltages at the second voltage line SVL and the gate line GL are discharged into the ground voltage line GVL, thereby slowly changing the falling edges of a high level gate voltage Vgh and a scanning signal SCS into an exponential function shape. In other words, the resistor R2 increases a time constant of the second voltage line SVL and the gate line GL when the one-contact control switch 52 is turned on. Accordingly, the falling edge of the high level gate voltage Vgh at the second voltage line SVL has a slower slope than the rising edge thereof as shown in FIG. 9. Also, the falling edge of the scanning signal SCS at the gate line GL changes more slowly than the rising thereof as shown in FIG. 9. The falling edges of the high level gate voltage Vgh and the scanning signal SCS are controlled more slowly than the rising edges thereof as described above, so that the liquid crystal display apparatus can suppress a feed through voltage )Vp sufficiently and have a rapid response speed.

Moreover, in the liquid crystal display apparatus according to the embodiments of the present invention as shown in FIG. 6, FIG. 8, FIG. 10 and FIG. 11, the switching operation of the voltage controller 46 is controlled by the gate scanning clock GSC, so that the timing controller 48 in FIG. 5 can be eliminated. As a result, the circuit configuration of the liquid crystal display apparatuses according to the second to fifth embodiments shown in FIG. 6, FIG. 8, FIG. 10 and FIG. 11 can be still more simplified. further, in the liquid crystal display apparatuses according to the second to fifth embodiments of the present invention, a duty cycle of the gate scanning clock has been expressed as 50%, but it may be controlled suitably in a range in which a voltage can be sufficiently charged in the liquid crystal cell.

Figure 12:
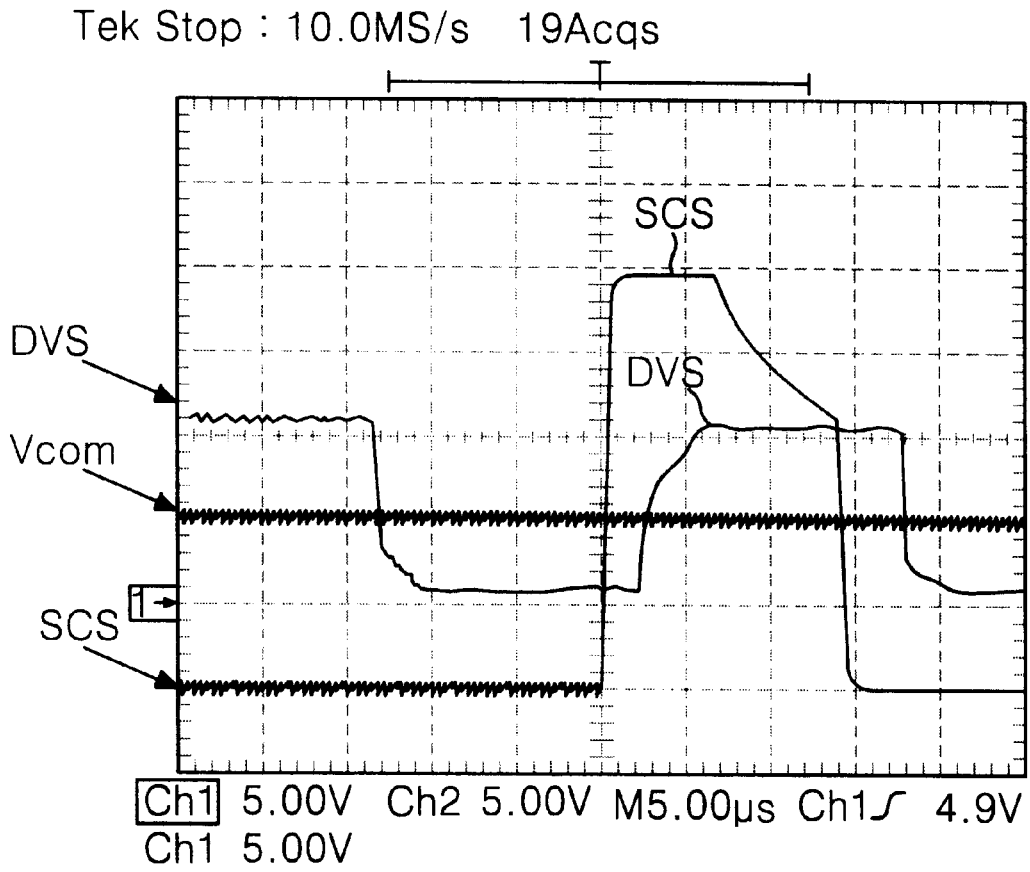
FIG. 12 is waveform diagrams of a scanning signal and a data voltage signal each developed on gate line and signal line of the liquid crystal display apparatus according to the first to fifth embodiments of the present invention.

FIG. 12 shows a scanning signal SCS and a data voltage signal DVS, each developed on gate line GL and signal line SL of the liquid crystal display apparatuses according to the first to fifth embodiments of the present invention. The voltage level of the scanning signal SCS shown in FIG. 12 approaches to the voltage level of the data voltage signal DVS at the falling edge of the scanning signal SCS. Therefore, in the liquid crystal display apparatus according to the present invention, the feed through voltage )Vp can be suppressed and the response speed enhanced.

Figure 13:
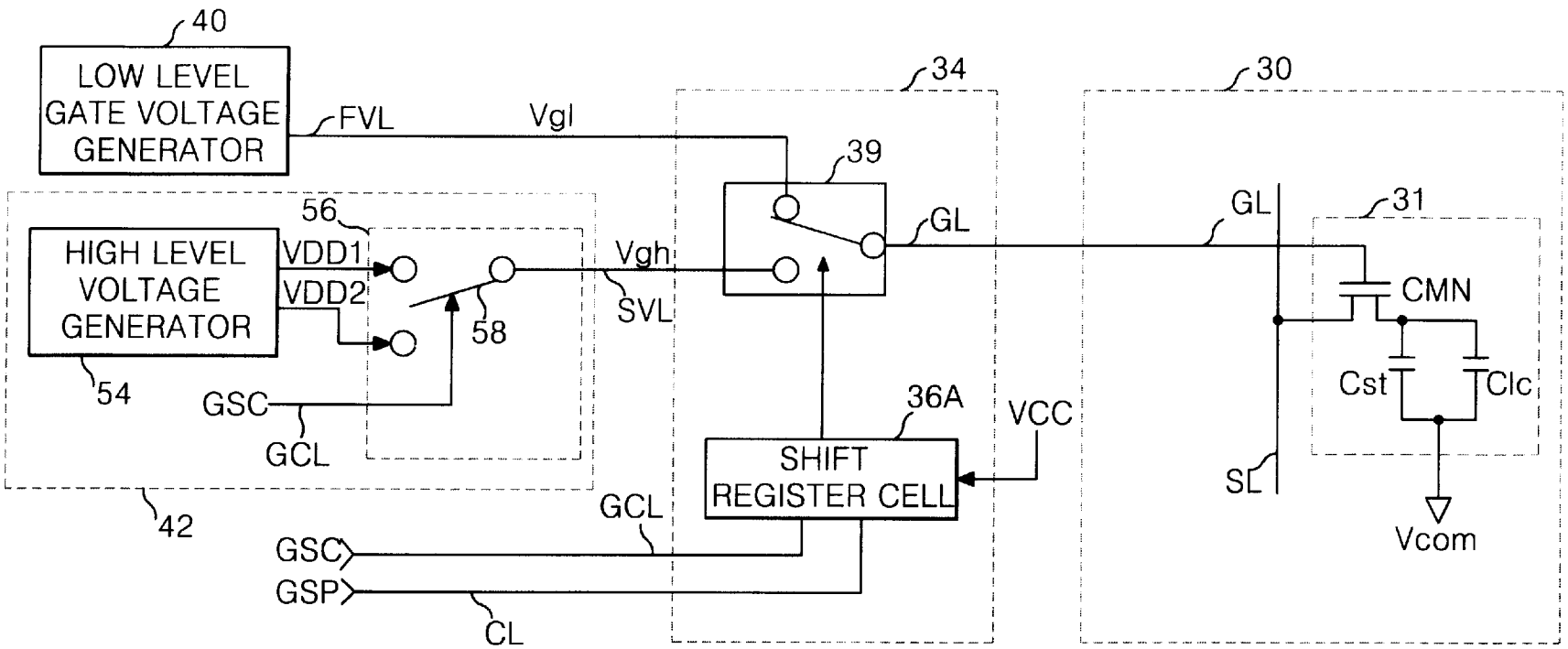
FIG. 13 is a schematic diagram showing the configuration of a liquid crystal display apparatus according to a sixth embodiment of the present invention.

FIG. 13 illustrates a liquid crystal display apparatus according to a sixth embodiment of the present invention. The liquid crystal display apparatus of FIG. 13 includes a low level gate voltage generator 40 and a high level gate voltage generator 42, each connected with a first voltage line FVL and a second voltage line SVL. The low level gate voltage generator 40 applies a low level gate voltage Vg1, maintaining a constant voltage level to a controlled switch 39 connected to the first voltage line FVL. The high level gate voltage generator 42 generates a pulse shape of a high level gate voltage Vgh, where a first high level voltage VDD1 is alternated with a second high level voltage VDD2, as shown FIG. 14.

In order to generate the high level gale voltage Vgh, the high level gate voltage generator 42 is composed of a high level voltage generator 54 for generating the first and second high level voltages VDD1 and VDD2 and a voltage controller 56 connected between the high level voltage generator 56 and the second voltage line SVL.

Figure 14:
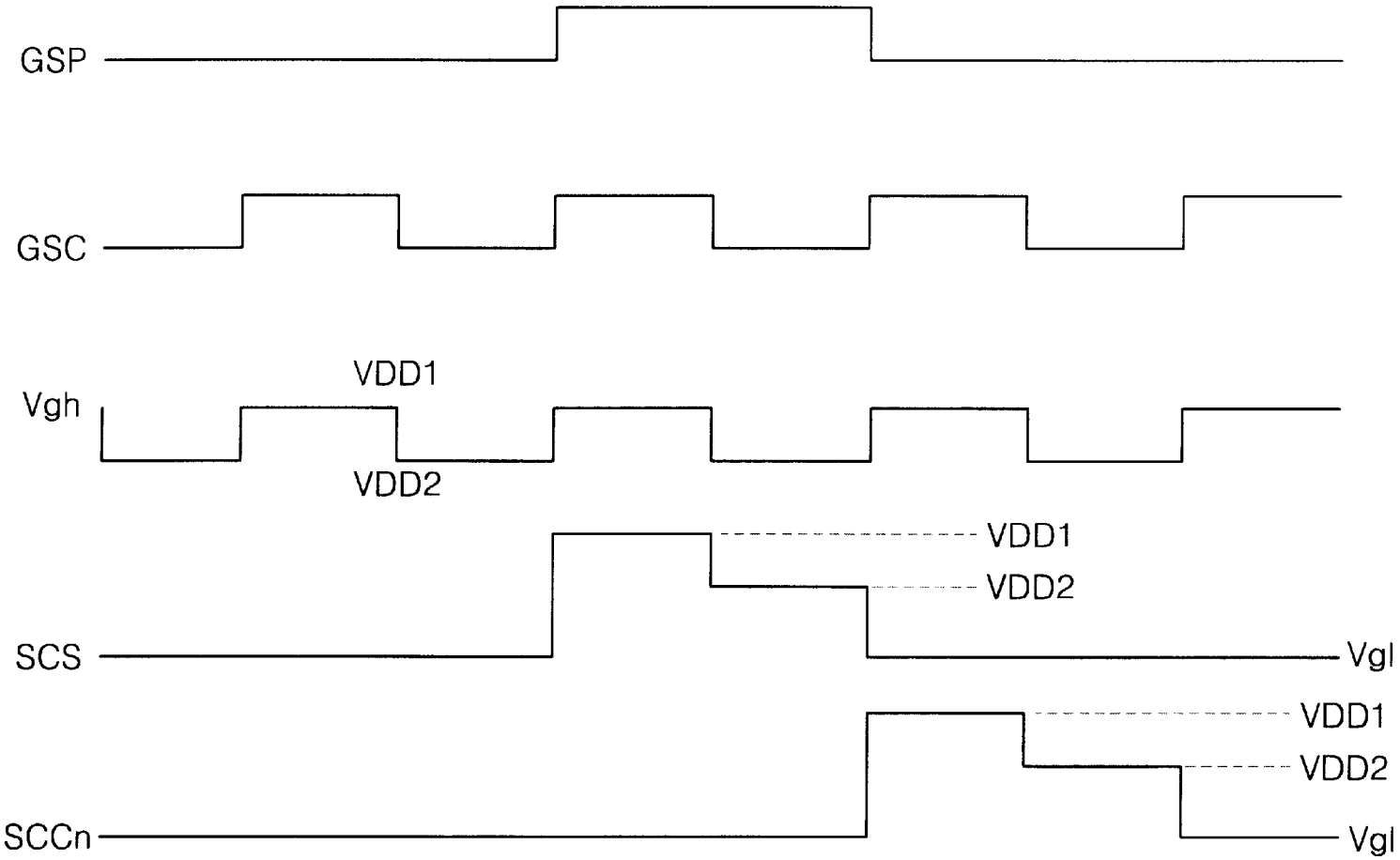
FIG. 14 is output waveform diagrams of each part of the liquid crystal display apparatus shown in FIG. 13.

The first high level voltage VDD1 generated in the high level voltage generator 54 maintains stably a constant voltage level, and the second high level voltage VDD2 has a constant voltage level between the first high level voltage and the low level gate voltage Vg1. The first and second high level voltages VDD1 and VDD2 are applied to the voltage controller 56. The voltage controller 56 supplies, alternatively, the first and second high level voltages to the second voltage line SVL, such that the high level gate voltage Vgh, as shown in FIG. 14, is developed on the second voltage line SVL.

The voltage controller 56 includes a second controlled switch 58 responding to a gate scanning clock GSC. During the high logic period of the gate scanning clock GSC, the second controlled switch 58 supplies the first high level voltage VDD1 to the second voltage line SVL, thereby appearing the first high level voltage Vgh on the second voltage line SVL. In the other hand, the second controlled switch 58 applies the second high level voltage VDD2 to the second voltage line SVL to develop the second high level voltage VDD2 on the second voltage line SVL, at the low logic period of the gate scanning clock GSC. As a result, the high level gate voltage Vgh has, sequentially, the first and second high level voltages VDD1 and VDD2, every period of the gate scanning clock GSC.

In the liquid crystal display apparatus of FIG. 13, there is included a gate driver 34 for driving gate lines GL on the liquid crystal panel 30. The liquid crystal panel 30 has pixels 31 , each connected with the signal line SL and the gate line. Each of the pixels 31 consists of a liquid crystal cell C1c for controlling a amount of lights passed through, its own responding to the data voltage signal DVS from the signal line SL, and a TFT for responding to the scanning signal SCS to switch the data voltage signal DVS to be supplied to the liquid crystal cell C1c. In the pixel, an additional capacitor Cst is also connected with the liquid crystal cells C1c in the parallel.

The gate driver 34 is composed of a shift register cell 36A for responding to a gate start pulse GSP from a control line CL and the gate scanning clock GSC from the gate clock line GCL, and a first controlled switch 39 connected between the shift register cell 36A and the gate line GL1. The shift register cell 36A outputs the gate start pulse GSP to its output terminal QT at the raising edge of the gate scanning clock GSC. Then, in the gate line GL1, there is developed a scanning signal SCS having the low level gate voltage Vg1 or the high level gate voltage Vgh. In detail, the first controlled switch 39 applies, sequentially, the first and second high level voltages VDD1 and VDD2 during the high logic period of the output signal from the shift register cell 39A, and applies the low level gate voltage Vg1 to the gate line GL1 when output signals of the shift register cell 36A go to the low logic. As a result, the scanning signal, as shown in FIG. 14, varied in a stepwise shape, is generated on the gate line GL1. A SCSn shows a wave form of a scanning signal to be applied to a next gate line.

Since the scanning signal SCS is varied in a stepwise fashion, the TFT CMN is turned off when the voltage of the scanning signal from the gate line GL1 drops into a voltage level lower than its threshold voltage. Then, although the charges in the liquid crystal cell C1c included in the pixel 31 are pumped toward the gate line GL1, the fully charged are charged in the liquid crystal cell C1c by the data voltage signal DVS from the signal line SL through the TFT CMN. Therefore, a voltage charged in the liquid crystal cell C1c is not decreased. In the case where high level gate voltage Vgh drops below the threshold voltage of the TFT CMN; the charge is pumped from the liquid crystal cell to the gate line GL1 because a maximum value of a voltage variation on the gate line GL1 becomes the threshold voltage of the TFT CMN. As a result, the feed through voltage )Vp is fully suppressed; furthermore, a flicker and residual image doesn't appear on a picture point displayed by the pixel 31.

In FIG. 13, the parasitic resistor Rp and the parasitic capacitor Cp, as shown in FIG. 5, exist on the gate line GL1 and affect the high level gate voltage Vgh but have been eliminated from the drawing for brevity.

Figure 15:
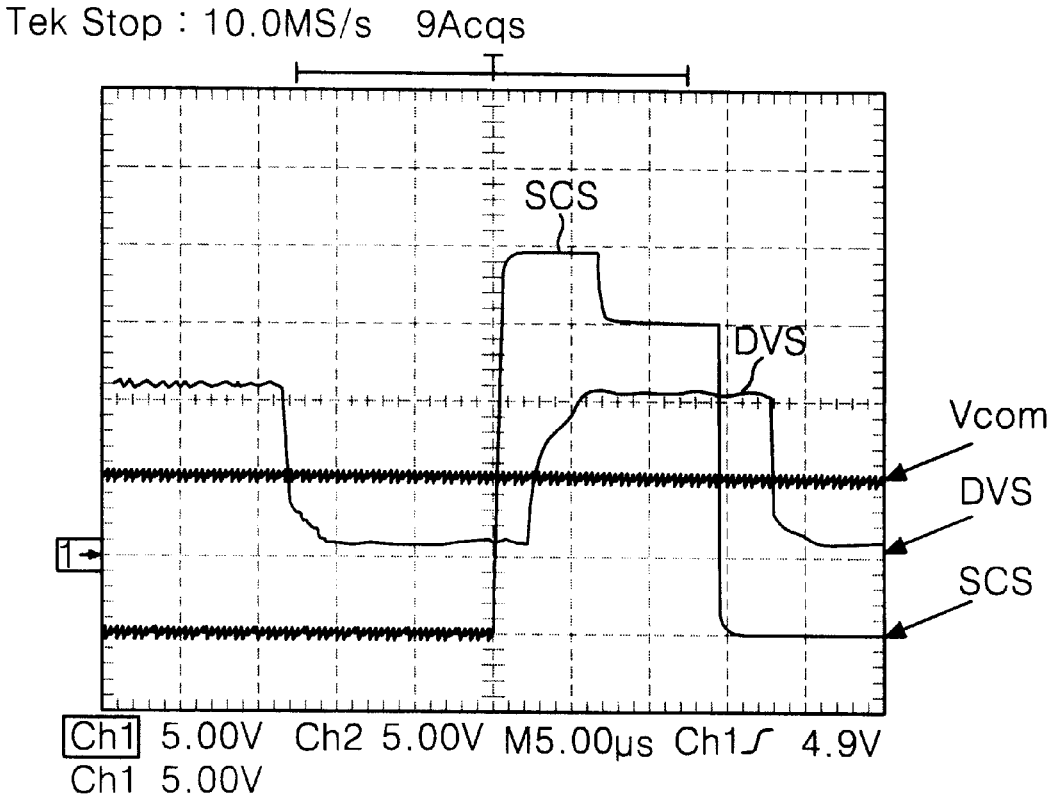
FIG. 15 is waveform diagrams of a scanning signal and a data voltage signal each developed on gate line and signal line of the liquid crystal panel as shown in FIG. 13.

FIG. 15 shows a scanning signal SCS and a date voltage signal DVS, each developed on gate line GL and signal line SL of the liquid crystal display apparatus, according to the sixth embodiment of the present invention. The falling edge of the scanning signal SCS changes in the shape of a linear function. The voltage level of the scanning signal SCS, shown in FIG. 15, approaches to the voltage level of the data voltage signal DVS at the falling edge of the scanning signal SCS. Therefore, in the liquid crystal display apparatus according to the present invention, the feed through voltage )Vp can be suppressed and the response speed is enhanced.

Figure 16:
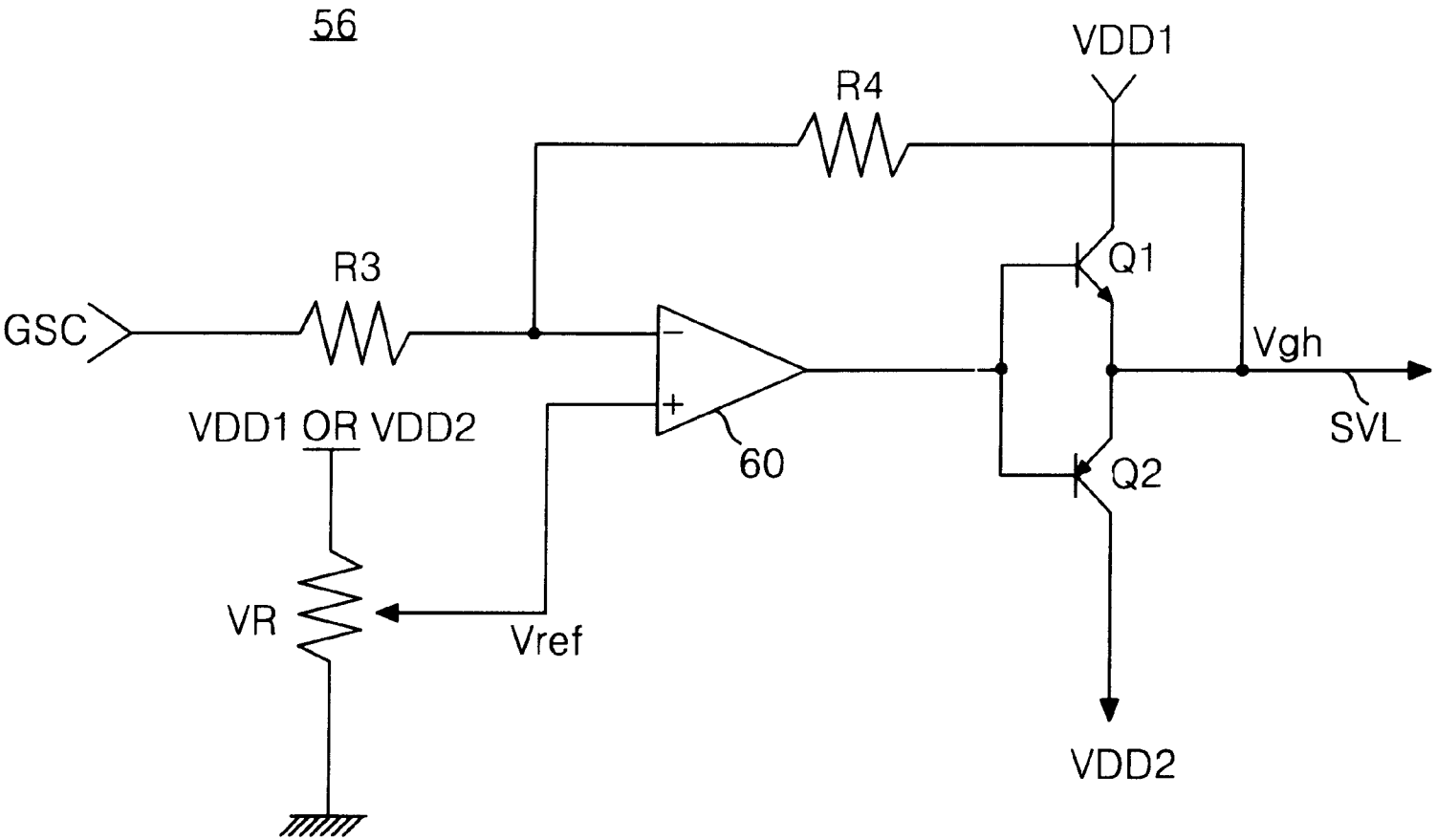
FIG. 16 is a schematic diagram showing another embodiment of the voltage controller shown in FIG. 13.

FIG. 16 illustrates another embodiment of the voltage controller 56 as shown in FIG. 13. The voltage controller 56 of FIG. 16 includes a comparator 60 for receiving the gate scanning clock GSC to its invert terminal "−" through a resistor R3, and first and second transistors Q1 and Q2 for responding complimentarily to the output signal of the comparator 60. The comparator 60 compares a reference voltage Vref from a variable resistor VR with the gate scanning clock GSC as shown in FIG. 17, and generates a comparison signal having a logic state according to a comparison resultant.

The comparator 60 applies a low logic of the comparison signal to the base terminals of the first and second transistors Q1 and Q2, in case the reference voltage Vref is higher than the gate scanning clock GSC. On the other hand, if the reference signal is lower than the gate scanning clock GSC, the comparator 60 supplies a high logic of the comparison signal to the base terminals of the first and second transistors Q1 and Q2. Then, the reference voltage Vref from the variable resistor VR divides a voltage difference between the first or second high level voltage VDD1 or VDD2 and a ground voltage GND, and applies the divided voltage to the non-invert terminal "+" of the comparator 60 as the reference voltage Vref. The first transistor Q1 applies the first high level voltage VDD1 from the high level voltage generator 54 of FIG. 13 to the second voltage line SVL, during the high logic period of the comparison signal from the comparator 60, while the second transistor Q2 supplies the second high level voltage VDD2 from the high level voltage generator 54 to the second voltage line SVL in the low logic interval of the comparison signal from the comparator 60.

Figure 17:
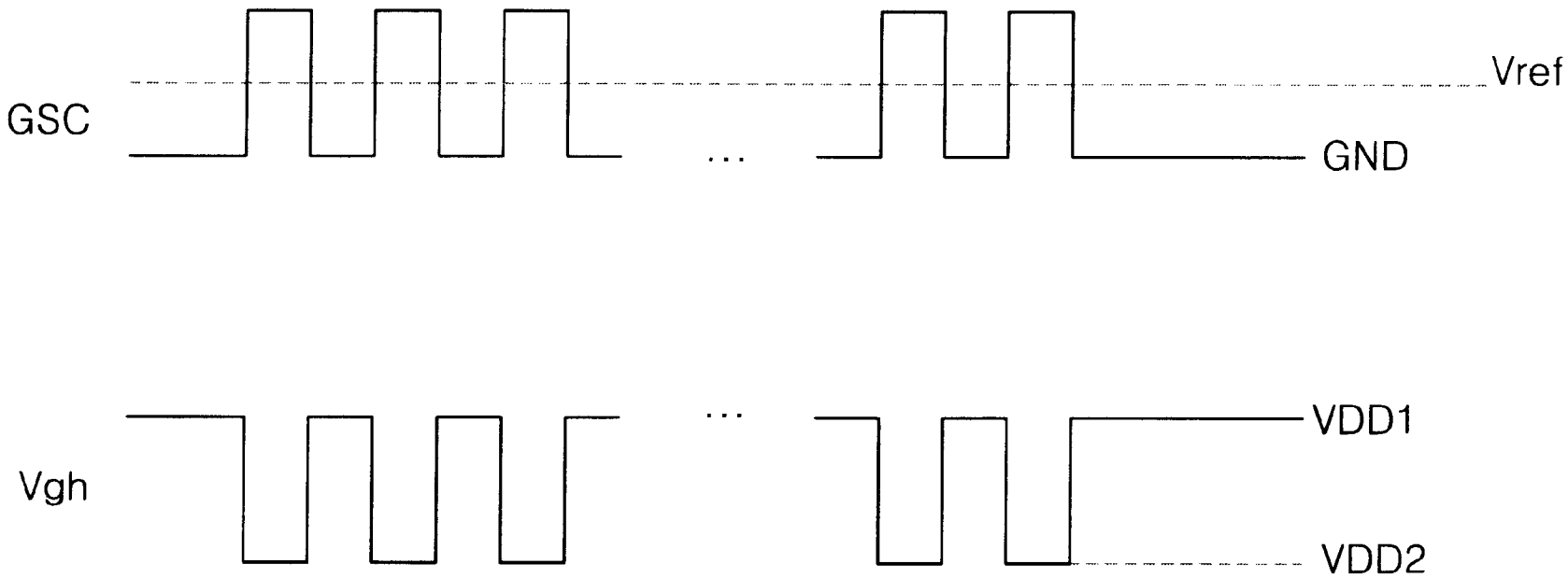
FIG. 17 is a waveform diagram showing input and an output signal of the voltage controller as shown in FIG. 16.

Therefore, on the second voltage line SVL, is developed the high level gate voltage signal Vgh, varying in the complementary with the gate scanning clock GSC, as shown in FIG. 17. The high level gate voltage Vgh has, alternatively, the first and second high level voltages VDD1 and VDD2 in response with the gate scanning clock GSC. Also, the high level gate voltage Vgh is used to a liquid crystal display apparatus, which the shift register cell 36A is to the falling edge of the gate scanning clock GSC. Furthermore, the high level gate voltage Vgh has an equal shape with the gate scanning clock GSC; in case these are changed, the first and second transistors Q1 and Q2 or the reference voltage and the gate scanning clock GSC are to be each applied to the invert and non-invert terminals "−" and "+" of the comparator 60. Meanwhile, a resistor R4, connected between the second voltage line SVL and the invert terminal "−" of the comparator 60, feeds back a voltage on the second voltage line SVL to the invert terminal "−" of the comparator 60, such that the high level gate voltage Vgh responds rapidly to the gate scanning clock GSC.

Figure 18:
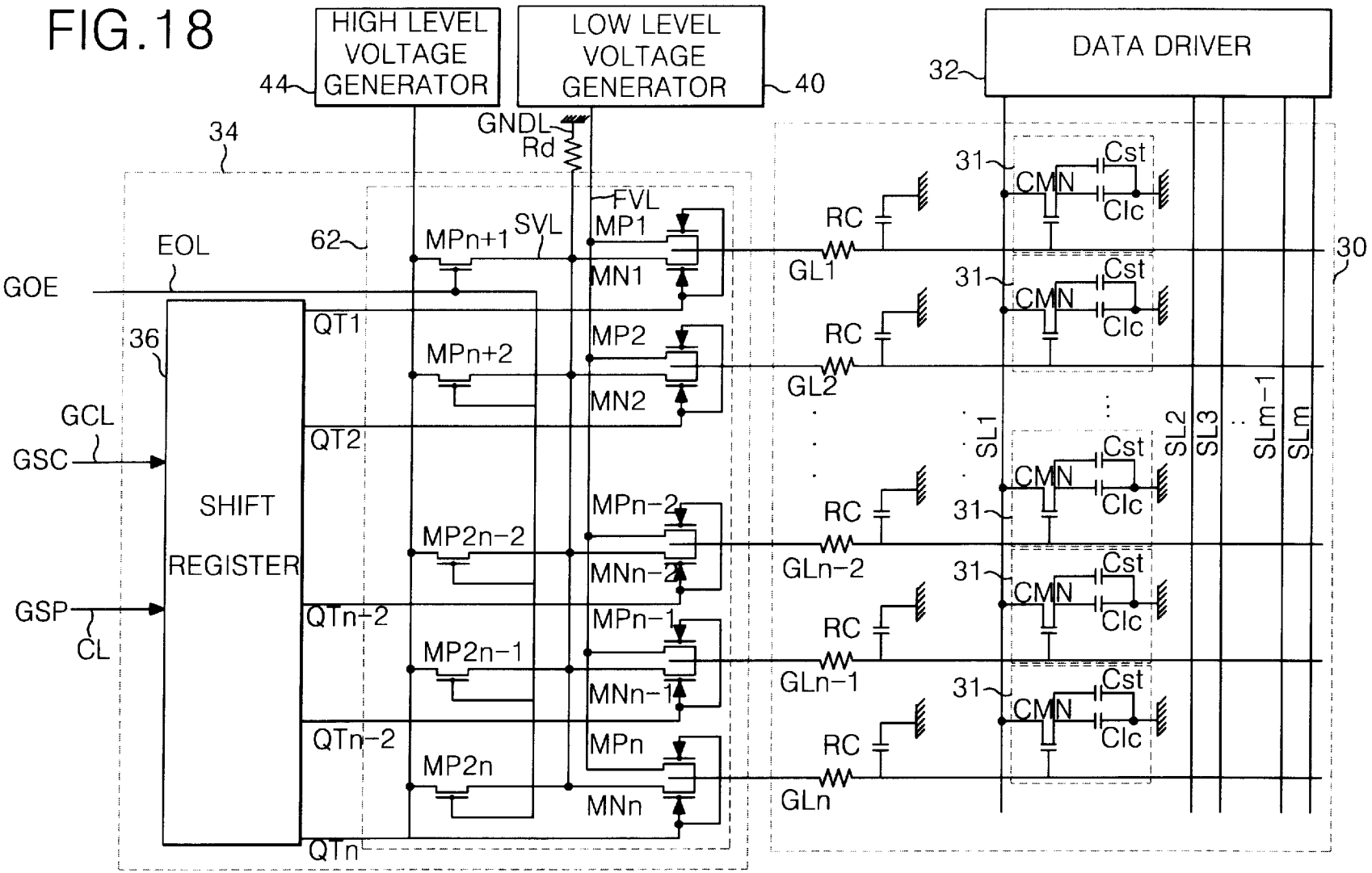
FIG. 18 is a schematic diagram showing the configuration of a liquid crystal display apparatus according to a seventh embodiment of the present invention.

Referring to FIG. 18, there is shown a liquid crystal display apparatus according to a seventh embodiment of the present invention that includes a data driver 32 for driving signal lines SL1 to SLm on a liquid crystal panel 30, and a gate driver 34 for driving gate lines GL1 to GLn on the liquid crystal panel 30. In the liquid crystal panel 30, pixels 31 connected to signal lines SL and gate lines GL, are arranged in an active matrix pattern. Each pixel 31 includes a liquid crystal cell C1c for responding to a data voltage signal DVS from the signal line SL to control a transmitted light quantity, and a thin film transistor(TFT) CMN for responding to a scanning signal SCS from the gate line GL to switch the data voltage signal DVS to be applied from the signal line SL to the liquid crystal cell C1c.

Each pixel 31 has a support capacitor Cst connected, in parallel, to the liquid crystal cell C1c. This support capacitor Cst serve to buff a voltage charged in the liquid crystal cell C1c. As the gate lines GL1 to GLn are sequentially driven, the data driver 32 applies the data voltage signal DVS to all the signal lines SL1 to SLm. The gate driver 34 allows the gate lines GL1 to GLn to be sequentially enabled for each horizontal synchronous interval by applying the scanning signal SCS to the gate lines GL1 to GLn sequentially.

The gate driver 34 has a shift register 36 responding to a gate start pulse GSP from a control line CL and a gate scanning clock GSC from a gate clock line GCL, and a level shifter 62 connected between the shift register 36 and the gate lines GL1 to GLn. The shift register 36 outputs the gate start pulse GSC from the control line CL to one of n output terminals QT1 to QTn and, at the same time, responds to the gate scanning clock GSC to shift the gate start pulse GSP from the first output terminal QT1 to the nth output terminal QTn, sequentially. Also, the shift register 36 operates at an integrated circuit driving voltage VCC having 5 V, corresponding to a logical voltage level.

The level shifter 62 generates n scanning signals SCS by shifting voltage levels of the output signals of the shift register 36. To this end, the level shifter 62 includes n PMOS transistors MP1 to MPn connected commonly to a first voltage line FVL, and n NMOS transistors MN1 to MNn connected commonly to a second voltage line SVL. The first voltage line FVL receives a low level gate voltage Vg1 from a low level gate voltage generator 40. The n PMOS transistors MP1 to MPn are connected to the gate lines GL1 to GLn, respectively. Also, the n PMOS transistors MP1 to MPn have gate electrodes each connected to the n output terminals QT1 to QTn of the shift register 36, respectively. Similarly, the n NMOS transistors MN1 to MNn are coupled to the gate lines CLl to GLn, respectively. Also, the n NMOS transistors MN1 to MNn have gate electrodes, each connected to the n output terminals QT1 to QTn of the shift register 36, respectively. Each PMOS transistor MP1 to MPn responds to a signal from the respective output terminal QT1 to QTn of the shift register 36 to be turned on in the complement to each NMOS transistors MN1 to MNn.

The first to nth PMOS transistors MP1 to MPn, each responding to the signals from the n output terminals QT1 to QTn of the shift register 36, are sequentially turned off by one horizontal synchronous period. Accordingly, the second voltage line SVL is sequentially connected to the n gate lines GL1 to GLn by one horizontal synchronous period. The gate driver 34 also has n PMOS transistors MPn+1 to MP2n, connected in parallel between the second voltage line SVL and a high level voltage generator 44, and a discharging resistor Rd connected between a ground line GNDL and the second voltage line SVL.

Figure 19:
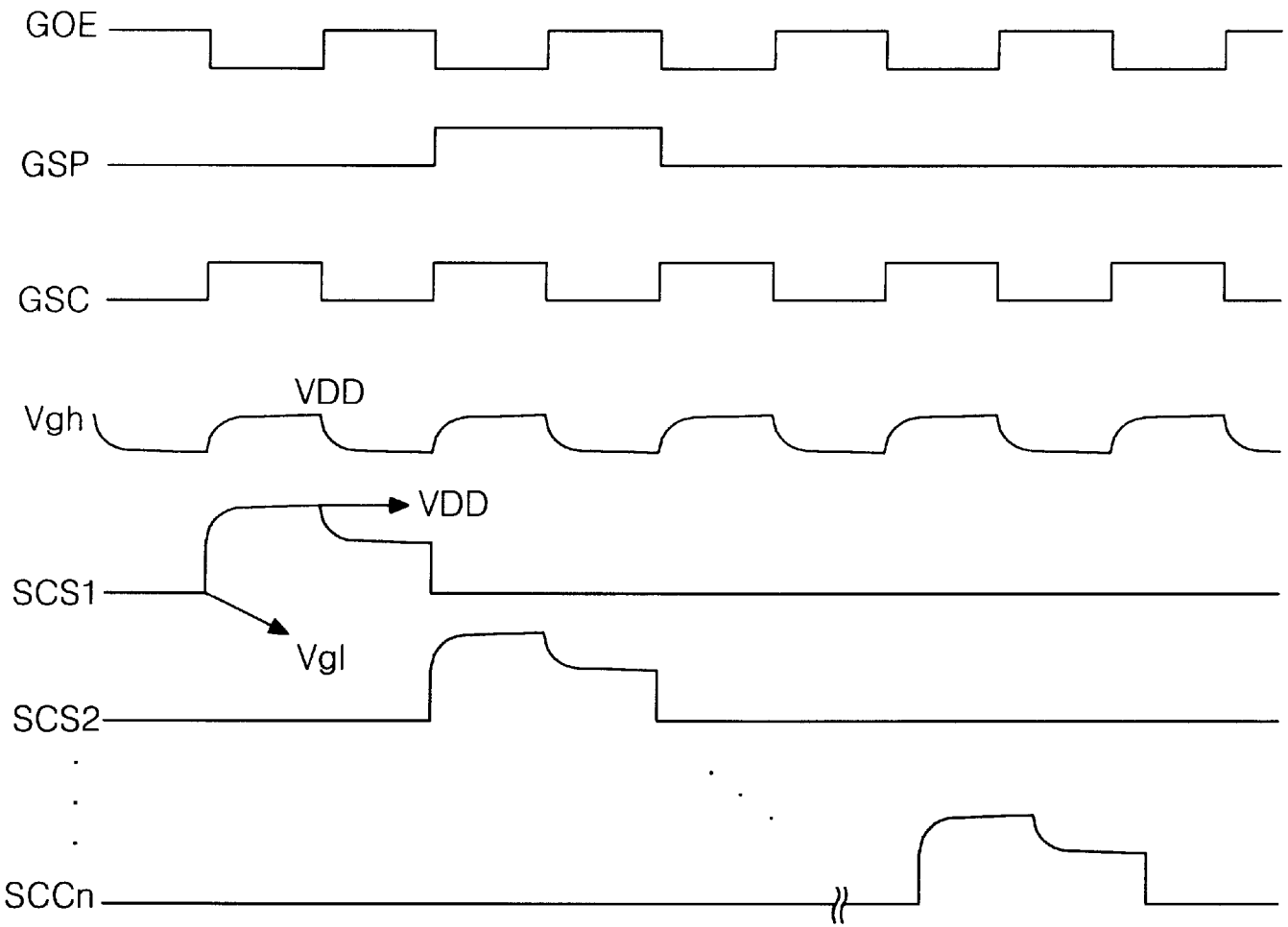
FIG. 19 is an output waveform diagram showing signals of each part of the liquid crystal display apparatus shown in FIG. 6.

The n PMOS transistors MPn+1 to MP2n, which are voltage controllers, respond commonly to a gate output enable signal GOE, as shown in FIG. 19, on an enable line EOL, thereby being turned on during a period from the start point to the middle point of the horizontal synchronous period. When the n PMOS transistors MPn+1 to MP2n are turned on, the high level voltage VDD generated at the high level voltage generator 44 is applied to any one of the n NMOS transistors MN1 to MNn via a parallel circuit of the n PMOS transistors MPn+1 to MP2n and the second voltage line SVL.

Meanwhile, if the n PMOS transistors MPn+1 to MP2n are turned off, the voltage charged in any one of the n gate lines GL1 to GLn is discharged into the ground line GNDL through the second voltage line SVL and the discharging resistor Rd. At the time, a discharging speed (a time constant) of the voltage on the gate line GL is determined by the discharging resistor Rd, a parasitic resistor Rc on the gate line GL and a parasitic capacitor Cc on the gate line GL. Therefore, there is generated a high level gate voltage Vgh at the second voltage line SVL. The high level gate voltage Vgh maintains the high level voltage VDD in the high logic interval of the gate scanning clock GSC (i.e., the front half of the horizontal synchronous signal HS) and drops down gradually from the high level voltage VDD in a shape of exponential function, as shown in FIG. 19.

The first to nth gate lines GL1 to GLn receive the high level gate voltage Vgh on the second voltage line SVL through the respective NMOS transistors NM1 to MNn during one period of the horizontal synchronous signal HS and input the low level gate voltage Vg1 on the first voltage line FVL via the respective PMOS transistors MP1 to MPn during a rest period. Consequently, the first to nth gate lines GL1 to GLn receive scanning signals SCS1 to SCSn as shown in FIG. 19, respectively. The scanning signal SCS maintains the high level voltage VDD in the high logic interval of the gate scanning clock GSC (i.e., the front half of the horizontal synchronous signal HS) and decreases slowly from the high level voltage VDD to the voltage approaching to a threshold voltage of the TFT CMN on the liquid crystal panel 30 in the exponential function shape. Also, the scanning signal SCS drops down rapidly into the voltage (i.e., the low level gate voltage Vg1) lower than the threshold voltage of the TFT CMN. As described above, since the falling edge of the scanning signal SCS applied to the gate line GL of the liquid crystal panel 30 changes gradually, the TFT CMN included in the pixel 31 is turned on until a voltage of the scanning signal SCS from the gate line GL drops less than its threshold voltage.

At this time, electric charge charged in a liquid crystal cell C1c is pumped into the gate line GL. However, sufficient electric charge is charged into the liquid crystal cell C1c by means of a data voltage signal DVS passing through the TFT CMN from a signal line SL. Accordingly, the voltage charged in the liquid crystal cell C1c does not decrease.

Since a voltage variation amount in the gate line GL is a maximum threshold voltage of the TFT CMN when a voltage of the scanning signal SCS at the gate line GL drops less than a threshold voltage of the TFT CMN, electric charge amount pumped from the liquid crystal cell C1c into the gate line GL becomes very small. As a result, a feed through voltage )Vp can be suppressed sufficiently. Further, the n PMOS transistors MPn+1 to MP2n lower a value of resistance between the second voltage line SVL and the high level voltage generator 44 in order to minimize an attenuation of the high level voltage VDD to be applied from the high level voltage generator 44 to the second voltage line SVL.

Accordingly, n−l PMOS transistors of the n PMOS transistors MPn+1 to MP2n can be eliminated. In this case, the gate driver 34 is simplified in a circuit configuration. Furthermore, the gate start pulse GSP, the gate scanning clock GSC and the gate enable signal GOE are generated at a timing controller (not shown).

Figure 20:
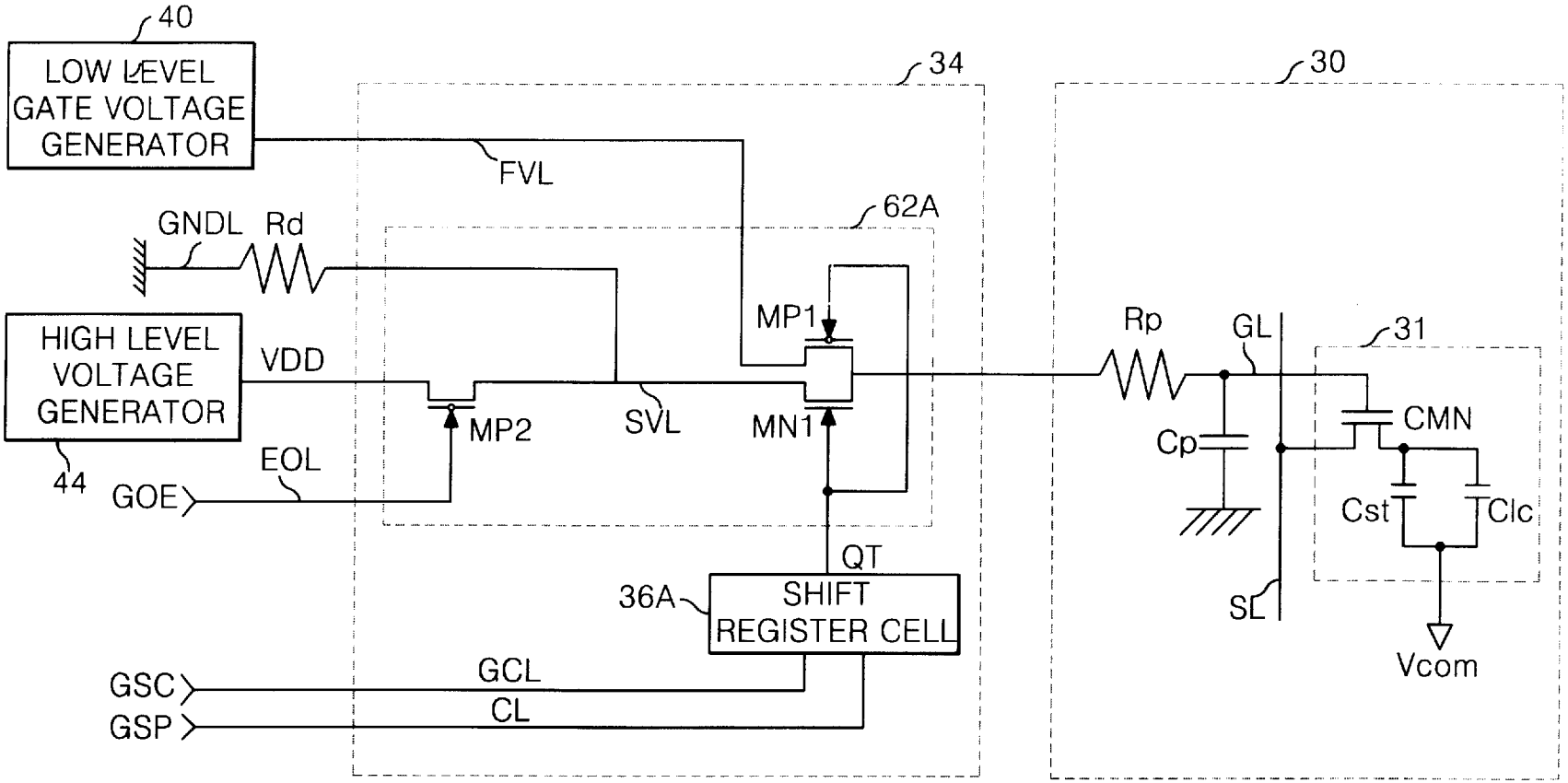
FIG. 20 is a schematic circuit diagram showing a line scanning circuit for driving any one of the gate lines included in the liquid crystal display apparatus shown in FIG. 18.

FIG. 20 shows a line scanning circuit for driving any one of the gate lines included in the active matrix liquid crystal display apparatus of FIG. 18. The line scanning circuit of FIG. 20 includes a gate driver 34 for driving a gate line GL on a liquid crystal panel 30. The liquid crystal panel 30 includes a pixel 31 connected to a signal line SL and the gate line GL. The pixel 31 includes a liquid crystal cell C1c for responding to a data voltage signal DVS from the signal line SL to control a transmitted light quantity, and a TFT CMN for responding to a scanning signal SCS from the gate line CL to switch the data voltage signal DVS to be applied from the signal line SL to the liquid crystal cell C1c. Also, the pixel 31 has a support capacitor Cst connected, in parallel, to the liquid crystal cell C1c.

The gate driver 34 consists of a shift register cell 36A responding to a gate start pulse GSP from a control line CL and a gate scanning clock GSC from a gate clock line GCL, and a level shifter cell 62A connected between the shift register cell 36A and the gate line GL. The shift register cell 36A outputs the gate start pulse GSP as shown in FIG. 19 at the rising edge of the gate scanning clock GSC as shown in FIG. 19 to an output terminal QT.

The level shifter 62A generates a scanning signal SCS by shifting voltage level of the output signal of the shift register cell 36A. To this end, the level shifter cell 62A includes a first PMOS transistor MP1 connected between a first voltage line FVL and a gate line GL on the liquid crystal panel 30, and a first NMOS transistor MN1 connected between a second voltage line SVL and the gate line GL. The first voltage line FVL receives a low level gate voltage Vg1 from a low level gate voltage generator 40. The PMOS transistor MP1 has a gate electrode connected to an output terminal QT of the shift register cell 36A. Similarly, the first NMOS transistor MN1 has a gate electrode connected to the output terminal QT of the shift register cell 36A. The first NMOS transistor MN1 responds to a signal from the output terminal QT of the shift register cell 36A to be turned on during an arbitrary horizontal synchronous period of a frame interval. The first PMOS transistor MP1 responding to the signal from the output terminal QT of the shift register cell 36A is turned-on during one frame interval, except the arbitrary horizontal synchronous period. Accordingly, the second voltage line SVL is connected to the gate line GL only during the arbitrary horizontal synchronous period, and the first voltage line FVL is coupled to the gate line GL during the frame interval, except the arbitrary horizontal synchronous period.

The level shifter cell 62A also has a second PMOS transistor MP2 connected between the second voltage line SVL and a high level voltage generator 44, and a discharging resistor Rd connected between a ground line GNDL and the second voltage line SVL. The second PMOS transistor MP2 responds to a gate output enable signal GOE, as shown in FIG. 19, on an enable line EOL, thereby being turned on during the period from the start point to the middle point of the horizontal synchronous period. When the second PMOS transistor MP2 is turned on, the high level voltage VDD generated at the high level voltage generator 44 is applied to the first NMOS transistor MN1 via the second PMOS transistor MP2 and the second voltage line SVL. On the other hand, in the case where the second PMOS transistor MP2 is turned off, the voltage charged in the gate lines GL is discharged into the ground line GNDL through the second voltage line SVL and the discharging resistor Rd.

A discharging speed (a time constant) of the voltage on the gate line GL is determined by the discharging resistor Rd, a parasitic resistor Rc on the gate line &L and a parasitic capacitor Cc on the gate line GL. Therefore, there is generated a high level gate voltage Vgh at the second voltage line SVL. The high level gate voltage Vgh maintains the high level voltage VDD in the high logic interval of the gate scanning clock GSC (i.e., the front half of the horizontal synchronous signal HS) and drops down gradually from the high level voltage VDD in a shape of exponential function, as shown in FIG. 19. The gate line GL receives the high level gate voltage Vgh on the second voltage line SVL through the first NMOS transistor NM1 during the arbitrary horizontal synchronous period and inputs the low level gate voltage Vg1 on the first voltage line FVL via the first PMOS transistor MP1 during the frame interval, except the arbitrary horizontal synchronous period.

Consequently, the gate line GL receives any one of scanning signals SCS1 to SCSn as shown in FIG. 19. The scanning signal SCS maintains the high level voltage VDD in the high logic interval of the gate scanning clock GSC (i.e., the front half of the horizontal synchronous signal HS) and decreases slowly from the high level voltage VDD to the voltage approaching to a threshold voltage of the TFT CMN on the liquid crystal panel 30 in the exponential function shape. Also, the scanning signal SCS drops down rapidly into the voltage (i.e., the low level gate voltage Vg1) lower than the threshold voltage of the TFT CMN.

As described above, since the falling edge of the scanning signal SCS applied to the gate line GL of the liquid crystal panel 30 changes gradually, the TFT CMN included in the pixel 31 is turned on until a voltage of the scanning signal SCS from the gate line GL drops less than its threshold voltage.

At this time, an electric charge charged in a liquid crystal cell C1c is pumped into the gate line GL. However, sufficient electric charge is charged into the liquid crystal cell C1c by means of a data voltage signal DVS passing through the TFT CMN from a signal line SL. Accordingly, the voltage charged in the liquid crystal cell C1c does not drop down. Then, since a voltage variation amount in the gate line GL is a maximum threshold voltage of the TFT CMN when a voltage of the scanning signal SCS at the gate line GL drops less than a threshold voltage of the TFT CMN, the electric charge amount pumped from the liquid crystal cell C1c into the gate line GL becomes very small. As a result, a feed through voltage Vp can be suppressed sufficiently.

Figure 21:
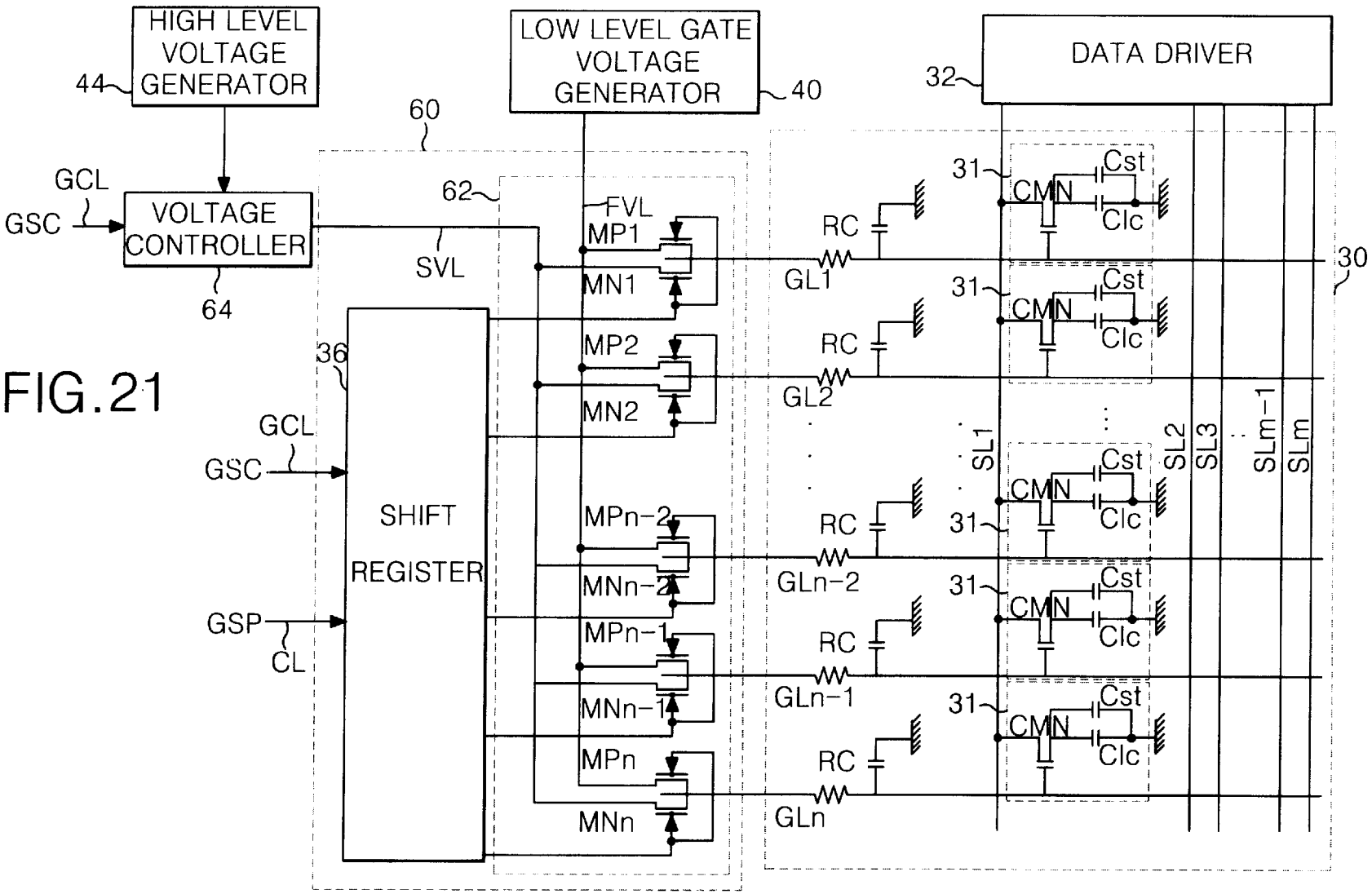
FIG. 21 is a schematic diagram showing the configuration of a liquid crystal display apparatus according to an eighth embodiment of the present invention.

FIG. 21 illustrates an active matrix liquid crystal display apparatus according to an eighth embodiment of the present invention. The liquid crystal display apparatus of FIG. 21 has a circuit configuration similar to that of FIG. 18, except that a voltage controller 64,is connected between the second voltage line SVL and the high level voltage generator 44 instead of the n PMOS transistors MPn+1to MP2n connected between the second voltage line SVL and the high level voltage generator 44 and the discharging resistor Rd connected between the second voltage line SVL and the ground line GNDL. The voltage controller 64 responds to a gate scanning clock GSC from the gate clock line GSL to connect the high level voltage generator 44 to the second voltage line SVL or to provide a discharging path to the second voltage line SVL. The voltage controller 64 transmits the high level voltage VDD from the high level voltage generator 44 to any one of the gate lines GL1 to GLn via the second voltage line SVL and any one of the n NMOS transistors MN1 to MNn when the scanning clock GSC has a high logic value.

When the gate scanning clock GSC goes to a low logic value, the voltage controller 64 provides the discharging path to the second voltage line SVL, thereby discharging a voltage charged in any one of the gate lines GL1 to GLn into the discharging path via the second voltage line SVL. At the time, a discharging speed (a time constant) of the voltage on the gate line GL is determined by the resistance value of the discharging path, a parasitic resistor Rc on the gate line GL and a parasitic capacitor Cc on the gate line GL. Consequently, the voltage controller 64 generates a high level gate voltage Vgh at the second voltage line SVL. The high level gate voltage Vgh maintains the high level voltage VDD in the high logic interval of the gate scanning clock GSC (i.e., the front half of the horizontal synchronous signal HS) and drops down gradually from the high level voltage VDD in a shape of exponential function, as shown in FIG. 19.

The first to nth gate lines GL1 to GLn receive the high level gate voltage Vgh on the second voltage line SVL through the respective NMOS transistors NM1 to MNn during one period of the horizontal synchronous signal HS. Also, each gate line GL1 to GLn inputs the low level gate voltage Vg1 on the first voltage line FVL via the respective PMOS transistors MPN to MPn during the frame interval, except one horizontal synchronous period.

Therefore, the first to nth gate lines GL1 to GLn receive scanning signals SCS1 to SCSn, as shown in FIG. 19, respectively. The scanning signal SCS maintains the high level voltage VDD in the high logic interval of the gate scanning clock GSC (i.e., the front half of the horizontal synchronous signal HS) and decreases slowly from the high level voltage VDD to the voltage approaching to a threshold voltage of the TFT CMN on the liquid crystal panel 30 in the exponential function shape. Also, the scanning signal SCS drops down rapidly into the voltage (i.e., the low level gate voltage Vg1) lower than the threshold voltage of the TFT CMN. As described above, since the falling edge of the scanning signal SCS applied to the gate line GL of the liquid crystal panel 30 changes gradually, the TFT CMN included in the pixel 31 is turned on until a voltage of the scanning signal SCS from the gate line GL drops less than its threshold voltage.

At this time, electric charge charged in a liquid crystal cell C1c is pumped into the gate line GL. However, sufficient electric charge is charged into the liquid crystal cell C1c by means of a data voltage signal DVS passing through the TFT CMN from a signal line SL. Accordingly, the voltage charged in the liquid crystal cell C1c does not drop down. Then, since a voltage variation amount in the gate line GL is a maximum threshold voltage of the TFT CMN when a voltage of the scanning signal SCS at the gate line GL drops less than a threshold voltage of the TFT CMN, an electric charge amount pumped from the liquid crystal cell C1c into the gate line GL becomes very small. As a result, a feed through voltage Vp can be suppressed sufficiently.

Figure 22A:
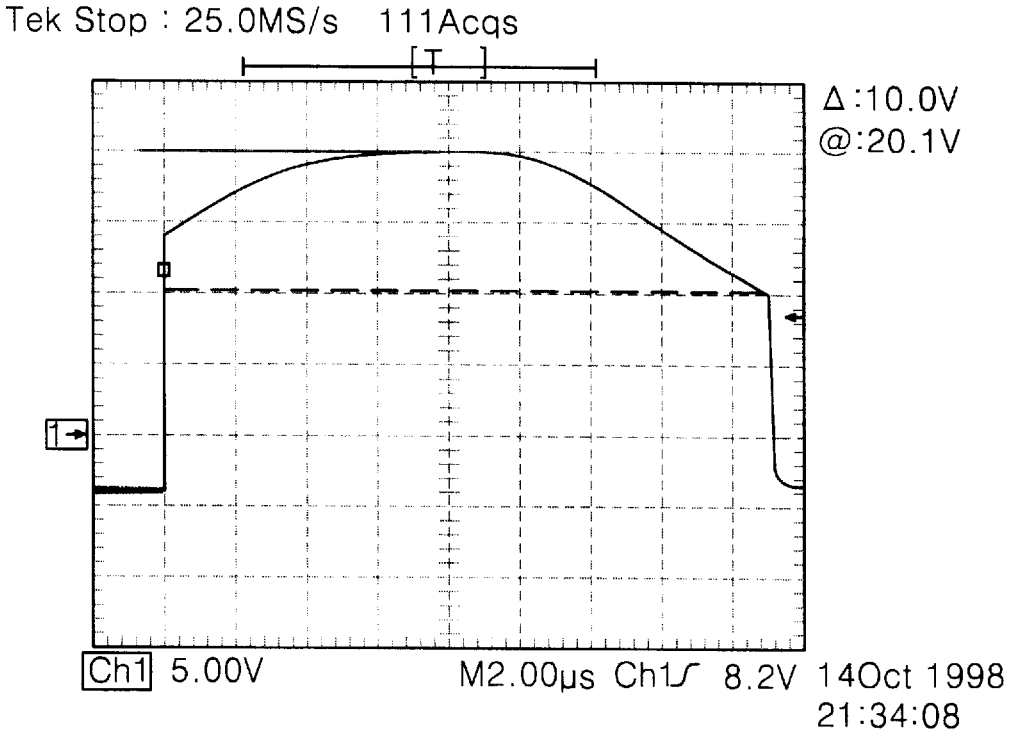
FIG. 22A is a waveform diagram showing a scanning signal generated by the liquid crystal display apparatus according to the present invention.
Figure 22B:
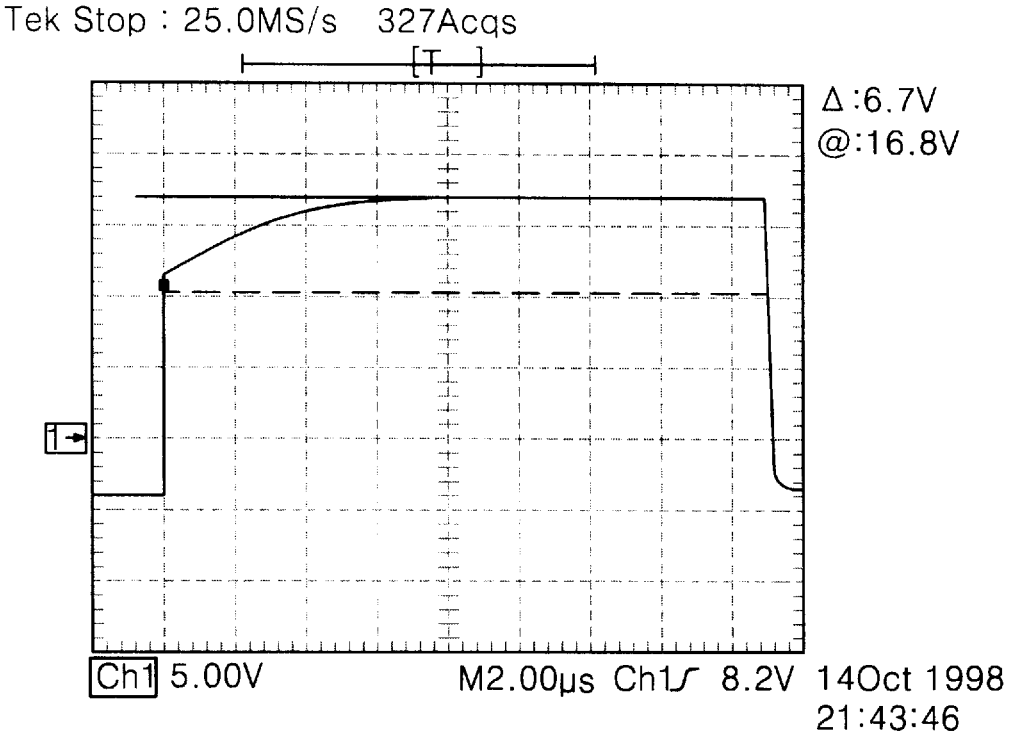
FIG. 22B is a waveform diagram showing a scanning signal generated by the prior liquid crystal display apparatus.

FIG. 22A shows a waveform of a scanning signal generated by the active matrix liquid crystal display apparatus according to the present invention. FIG. 22B depicts a waveform of a scanning signal provided by the conventional active matrix liquid crystal display apparatus. The scanning signal has a falling edge decreasing gradually in a shape of exponential function and differing to that of the scanning signal as shown in FIG. 22B. Consequently, the active matrix liquid crystal display apparatus according to the present invention reduces a potential difference between the gate and source electrodes of the TFT CMN when the TFT CMN is turned off. Also, an electric charge amount discharged from the liquid crystal cell C1c becomes very small. As a result, a feed through voltage Vp can be suppressed sufficiently. Further, a flicker is substantially reduced.

Figure 23A:
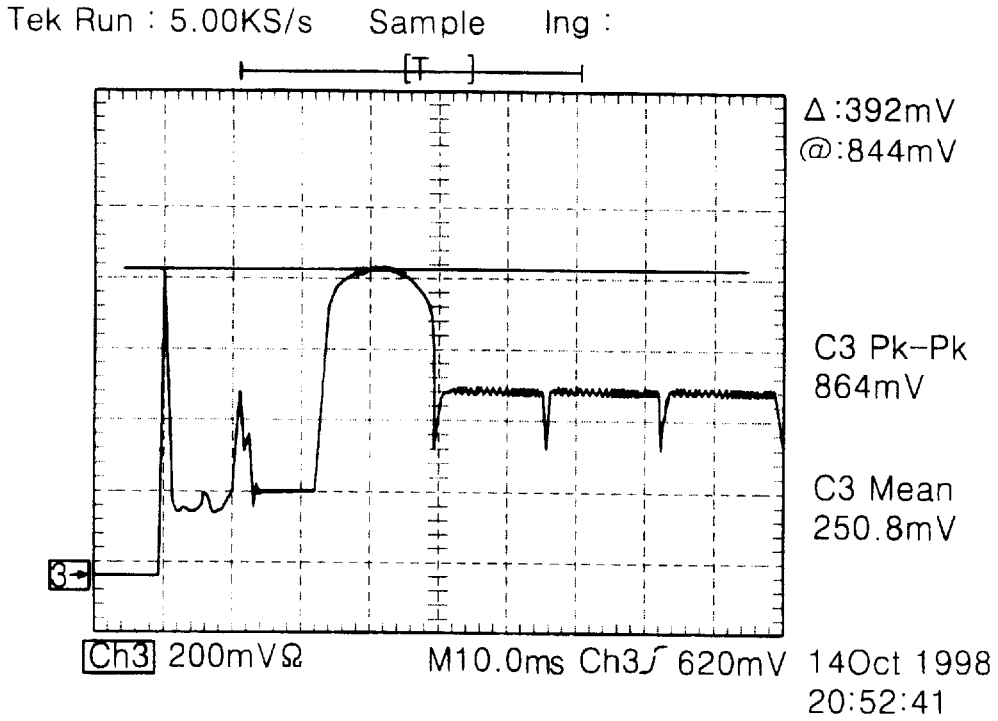
FIG. 23A is a waveform diagram showing a current characteristic developed on the liquid crystal display apparatus according to the present invention.
Figure 23B:
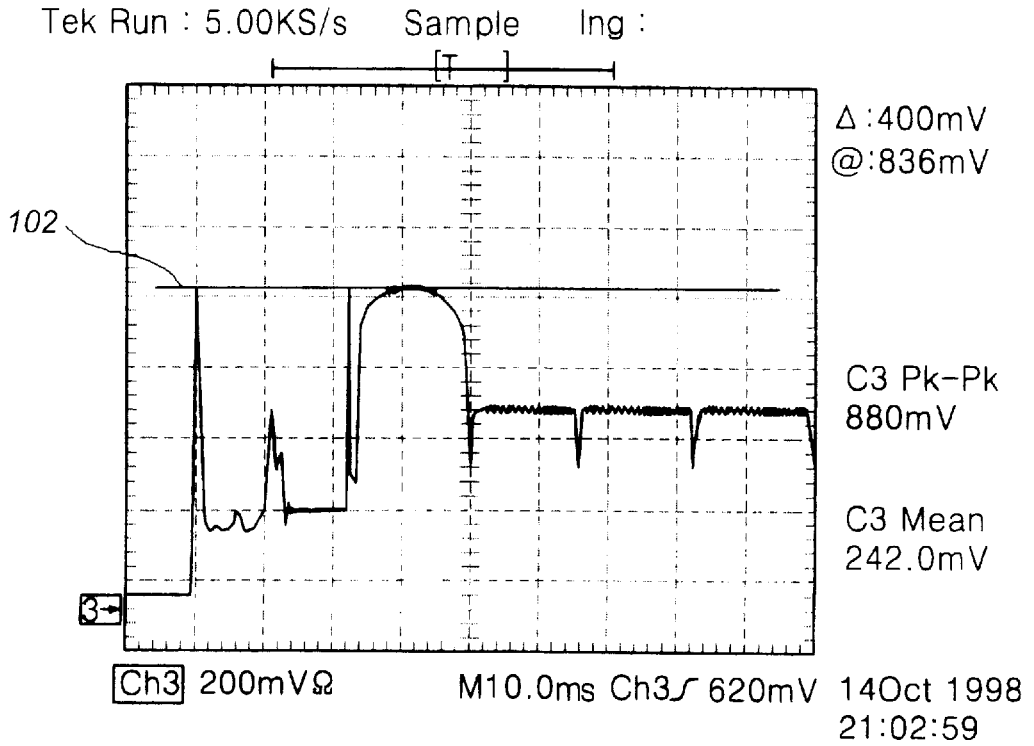
FIG. 23B is a waveform diagram showing a current characteristic developed on a prior liquid crystal display apparatus.

FIG. 23A shows a current variation on any one of gate lines GL when the active matrix liquid crystal display apparatus according to the present invention drives the TFT CMN. FIG. 23B depicts a current variation on any one of gate lines GL when the conventional active matrix liquid crystal display apparatus drives the TFT CMN. Referring to FIGS. 23A and 23B, an overshoot noise component 102 is greatly suppressed by means of the active matrix liquid crystal display apparatus according to the present invention.

Figure 24:
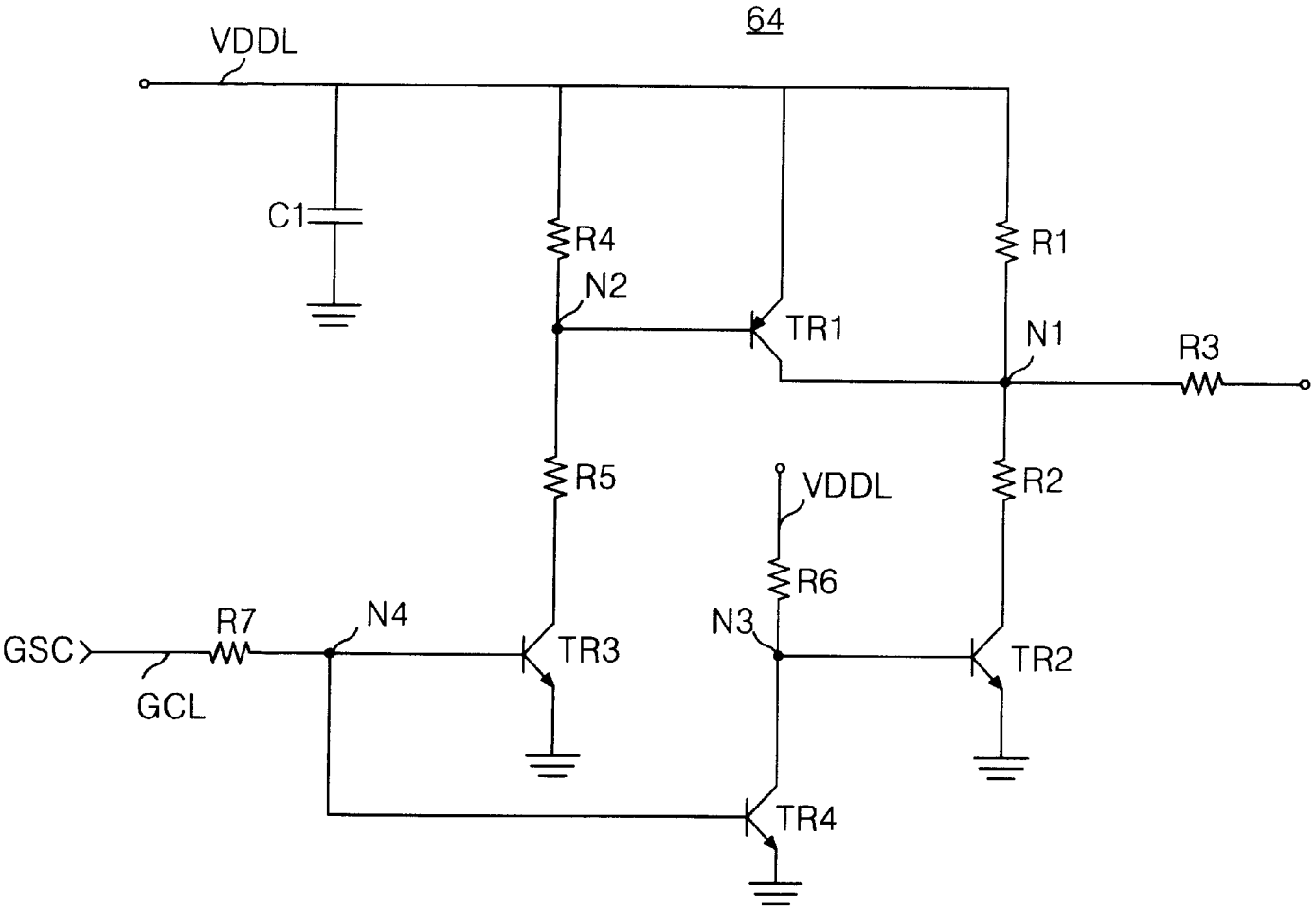
FIG. 24 is a circuit diagram showing in detail the voltage controller shown in FIG. 21.

FIG. 24 illustrates in detail an embodiment of the voltage controller 64 shown in FIG. 21. The voltage controller 64 of FIG. 24 includes a first and a second resistor R1 and R2 connected in series between a high level voltage line VDDL and a ground line GNDL, and a third resistor R3 connected between a first node N1 and a second voltage line SVL. The first and second resistors R1 and R2 divide a high level voltage VDD on the high level voltage line VDDL, thereby emerging a divided voltage at the first node N1. The third resistor R3 limits a quantity of current between the first node N1 and the second voltage line SVL.

The voltage controller 64 further includes a first transistor TR1 connected between the first node N1 and a second node N2, a second transistor TR2 connected between the second resistor R2 and the ground line GNDL. The first transistor TR1 responds to a voltage on the second node N2 and transmits selectively the high level voltage on the high level voltage line VDDL toward the first node N1. In detail, the first transistor TR1 is turned on when the voltage on the second node N2 is in a voltage below its threshold voltage (i.e., 0.7V), so as to allow the voltage on the first node N1 to maintain the high level voltage VDD. Meanwhile, if the voltage on the second node N2 is in a voltage above the threshold voltage of the transistor TR, the first transistor TR1 is turned off to open a current path between the first node N1 and the high level voltage line VDDL. The first transistor TR1 employs a junction transistor of P-type. The voltage on the second node N2 is varied with an operating state of a third transistor TR3 having a base electrode connected to a fourth node N4. The third transistor TR3 is turned on when a gate scanning clock GSC on the fourth node N4 has a high logic value, thereby forming a current path which proceeds from the high level voltage line VDDL to the ground line GNDL through a fourth resistor R4, the second node N2, and its emitter and collector electrodes.

In this case, there is developed the voltage lower than the threshold voltage of the transistor TR at the second node N2. On the other hand, if the gate scanning clock GSC on the fourth node N4 is in a low logic value, the third transistor TRs is turned off, such that the high level voltage is developed on the second node N2. Meanwhile, the second transistor TR2 responds to the voltage on the third node N3 to connect selectively the second resistor R2 to the ground line GNDL. In detail, the second transistor TR2 connects the second resistor R2 to the ground line GNDL when the voltage on the third node N3 is higher than its threshold voltage. At this time, the voltage on the second voltage line SVL is discharged into the ground line GNDL via the third resistor R3, the first node N1, the second resistor R2, and its collector and emitter electrodes. Meanwhile, if the voltage on the third node N3 is lower than the threshold voltage of the second transistor TR2, the second transistor TR3 opens the second resistor R2 from the ground line GNDL.

The second transistor TR2 employs a junction transistor of N-type. The voltage on the third node N3 is varied with an operating status of a fourth transistor TR4 having a base electrode connected to the fourth node N4. The Fourth transistor TR4 is turned on when the gate scanning clock GSC from the fourth node N4 has the high logic value, thereby connecting the third node N3 to the ground line GNDL. Thus, the ground voltage GND emerges on the third node N3. On the other hand, if the gate scanning clock GSC on the fourth node N4 has a high logic value, the fourth transistor TR4 is turned off to charge the high level voltage VDD on the high level voltage line VDDL into the third node N3 via the third resistor R3.

Consequently, the voltage on the second node N2 varies in the same shape to that on the third node N3. Since the voltages on the second and third nodes N2 and N3 have the same shape, the first and second transistors TR1 and TR2 are alternatively driven. In other words, The first transistor TR1 is turned in the high logic interval of the gate scanning clock GSC and the second transistor TR2 in the low logic interval of the gate scanning clock GSC. Accordingly, the voltages on the first node N1 and the second voltage line SVL are equal to the high level voltage VDD in the high level interval of the gate scanning clock GSC and decrease in exponential function shape from the high level voltage VDD to the divided voltage level. As a result, a high level gate voltage Vgh having a waveform is generated as shown in FIG. 19 on the second voltage line SVL.

The gate scanning clock GSC is applied from the gate clock line GCL to the fourth node N4 through a seventh resistor R7. The seventh resistor R7 limits a quantity of current flowing from the gate clock line GCL to the fourth node N4 via the seventh resistor R7. The second and third resistors R2 and R3 determine discharging speed of the voltage on the gate line GL together with a parasitic resistor Rc and a parasitic capacitor Cc existing on the gate line GL which is connected to the second voltage line SVL.

Figure 25:
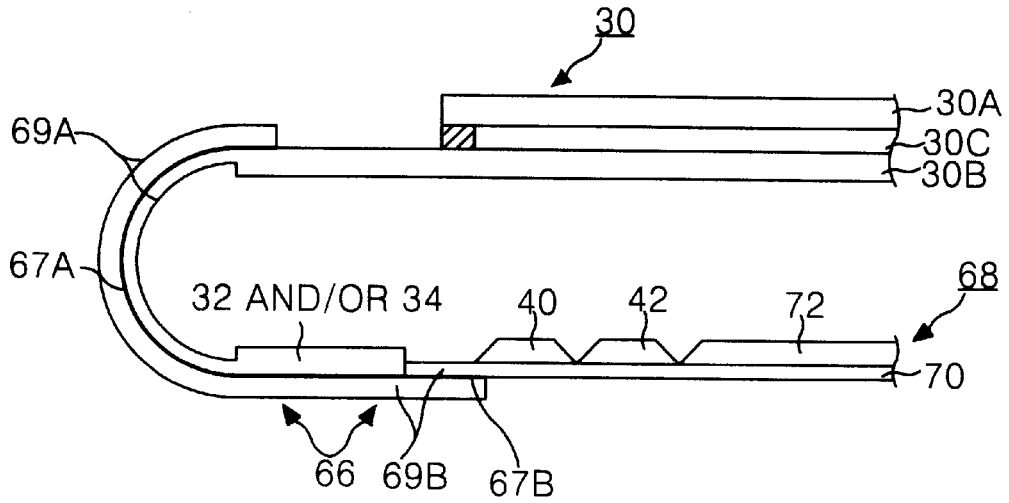
FIG. 25 shows a tab type of liquid crystal display apparatus according to the present invention.

FIG. 25 shows a tab type of liquid crystal display apparatus according to the present invention. In the tab type of the liquid crystal display apparatus shown in FIG. 25, a liquid crystal panel 30 is provided with a liquid crystal layer 30C sealed between an upper glass substrate 30A and a lower glass substrate 30B. The liquid crystal panel 30 is connected with a PCB (Printed Circuit Board) module 68 by a FPC (Flexible Printed Circuit) film 66. The PCB module 68 has a control circuit 72, a low level gate voltage generator 40 and a high level gate voltage generator 42 on a PCB 70. The FPC film 66 has one end connected with the pad area of the lower glass substrate 30B, and another end coupled with the edge of the undersurface of the PCB 70. In the intermediate portion of the FPC film 66, date drivers 32 and/or gate drivers 34 are installed. The data drivers 32 and/or the gate drivers 34 are connected with the liquid crystal panel 30 and the PCB module 68 by the FPC film 66. The FPC film 66 has a first conductive layer pattern 67A connecting the liquid crystal panel 30 with the data drivers 32 and/or the gate drivers 34, and a second conductive layer pattern 67B coupling electrically the data drivers 32 and/or the gate drivers 34 and the PCB module 68. The first and second conductive layer patterns 67A and 67B are each surrounded with first and second protective films 69A and 69B in such a manner that both ends of the first and second conductive layer patterns 67A and 67B are exposed, too.

Figure 26:
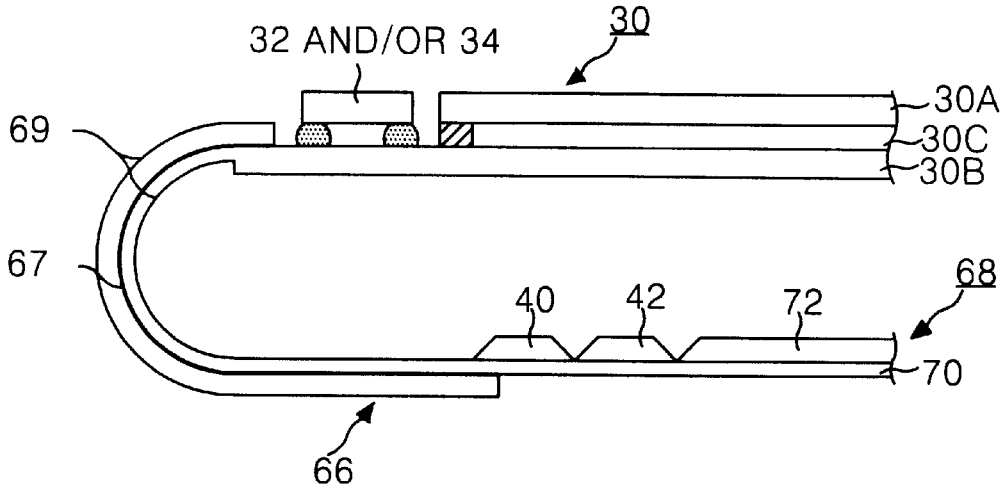
FIG. 26 shows a COG type of liquid crystal display apparatus according to the present invention.

FIG. 26 shows a COG (Chips On Glass) type of liquid crystal display apparatus according to the present invention. In the COG type of the liquid crystal display apparatus shown in FIG. 26, a liquid crystal panel 30 is provided with a liquid crystal layer 30C sealed between an upper glass substrate 30A and a lower glass substrate 30B. The liquid crystal panel 30 is connected with a PCB module 68 by a FPC film 66. The PCB module 68 has a control circuit 72, a low level gate voltage generator 40 and a high level gate voltage generator 42 loaded thereon. Data drivers 32 and/or gate drivers 34 are mounted on the pad area of the lower glass substrate 30B. The data drivers 32 and/or the gate drivers 34 are connected with the PCB module 68 by the FPC film 66. The FPC film 66 connects the PCB module 68 with the liquid crystal panel 30, loading with the data drivers 32 and/or the gate drivers 34 thereon. The FPC film 62 has one end connected with the pad area of the lower glass substrate 30B, and another end coupled with the edge of the under surface of the PCB 70. The FPC film 66 has a conductive layer pattern 67 connecting electrically the liquid crystal panel 30 with the PCB module 68. The conductive layer pattern 67 is surrounded with a protective film 69 in such a manner that both ends of the conductive layer pattern 67 are exposed, too.

The low level gate voltage generator and the high level gate voltage generator included in the present invention are located on the PCB module and the voltage controller can be arranged on the LCD module in various pattern. Firstly, the voltage controller is installed on the PCB module. In other words, the high level gate voltage generator, the low level gate voltage generator and the voltage controller are arranged on the PCB module. When such a circuit configuration is used for the LCD apparatus, the conventional gate driver IC also can be smooth the falling edge of the gate pulse. Consequently, the object of the present invention can be accomplished without modifying the gate driver IC.

Secondly, the voltage controller is inserted into the gate driver IC. The voltage controller included in the gate driver IC can be formed the high level gate voltage generator and the buffer as shown in FIG. 18. On the other hand, the voltage controller included in the gate driver IC can be connected between the high level gate voltage generator and a plurality of buffers. The gate driver IC including the voltage controller allows the LCD module to have a small number of elements relative to the LCD module having the voltage controller arranged on the PCB module. Also, the gate driver having the voltage controller enables the cost of element to decrease.

As described above, in the liquid crystal display apparatus according to the present invention, a high level gate voltage is supplied to the level shifter of the gate driver in the alternating current shape, thereby changing the falling edge of the scanning signal into any one of the linear, exponential or ramp function shapes. Accordingly, the liquid crystal display apparatus according to the present invention is capable of suppressing the feed through voltage Vp sufficiently, as well as preventing an occurrence of a flicker and a residual image. Furthermore, the liquid crystal display apparatus according to the present invention has a very simplified circuit configuration.

Moreover, in the liquid crystal display apparatus according to the present invention, the falling edge of the high level gate voltage has a slower slope than the rising edge thereof, thereby changing the falling edge of the scanning signal to be applied to the gate line more slowly than the rising edge thereof. Accordingly, the liquid crystal display apparatus according to the present invention is capable of preventing an occurrence of a flicker and a residual image as well as providing a rapid response speed.

Although the present invention has been explained by the embodiments shown in the drawings hereinbefore, it should be understood to the ordinary skilled person in the art that the invention is not limited to the embodiments but, rather than that, various changes or modifications thereof are possible without departing from the spirit of the invention. Accordingly, the scope of the invention shall be determined only by the appended claims and their equivalents.

What is claimed is:

1. A liquid crystal display apparatus, comprising:

a plurality of pixels including switching transistors, each switching transistor having an electrode connected to a pixel electrode and a gate electrode;

a plurality of data signal lines connected to the electrode associated with any one of the transistors;

a plurality of gate signal lines connected to the gate electrode associated with any one of the transistors; and a gate driver connected to the plurality of gate signal lines, the gate driver receiving first and second voltages and outputting at least one of the first and second voltages in such a manner to sequentially drive the gate signal lines, the first voltage changing prior to driving successive gate signal lines, wherein the gate driver includes:

a shift register for generating scanning signals to be applied respectively to the gate lines, wherein the shift register is responsive to a gate scanning clock;

a level shifter making use of the first and second voltages to generate each voltage level of the scanning signals; and a voltage controller for changing the first voltage applied to the level shifter prior to disabling of the scanning signals;

wherein the voltage controller includes:

an input terminal for receiving the first voltage;

a first resistor connected between the input terminal and an input port of the level shifter;

a first control switch and a second resistor connected in series between the input port of the level shifter and a ground voltage line; and a second control switch connected in parallel to the first resistor, the second control switch being driven alternatively with the first control switch.

2. The liquid crystal display apparatus of claim 1, wherein the first voltage decreases prior to driving of the successive gate signal lines.

3. The liquid crystal display apparatus of claim 1, wherein the first voltage decreases exponentially.

4. The liquid crystal display apparatus of claim 1, wherein the first voltage decreases linearly.

5. The liquid crystal display apparatus of claim 1, wherein the first voltage is stepwisely decreased.

6. The liquid crystal display apparatus of claim 1, wherein a minimum value of the first voltage is higher than a maximum value of the second voltage.

7. The liquid crystal display apparatus of claim 1, wherein the shift register and the level shifter are fabricated to include in an integrated circuit chip.

8. The liquid crystal display apparatus of claim 1, wherein the shift register, the voltage controller and the level shifter are fabricated to include in an integrated circuit chip.

9. A method of manufacturing a liquid crystal display apparatus, the method comprising the steps of:

providing a plurality of pixels including switching transistors, each switching transistor having an electrode connected to a pixel electrode and a gate electrode;

providing a plurality of data signal lines connected to the electrode associated with any one of the transistors;

providing a plurality of gate signal lines connected to the gate electrode associated with any one of the transistors; and connecting a gate driver to the plurality of gate signal lines, the gate driver receiving first and second voltages and outputting at least one of the first and second voltages in such a manner to sequentially drive the gate signal lines, the first voltage changing prior to driving successive gate signal lines, wherein the gate driver includes:

a shift register for generating scanning signals to be applied respectively to the gate lines, wherein the shift register is responsive to a gate scanning clock;

a level shifter making use of the first and second voltages to generate each voltage level of the scanning signals; and a voltage controller for changing the first voltage applied to the level shifter prior to disabling of the scanning signals;

wherein the voltage controller includes:

an input terminal for receiving the first voltage;

a first resistor connected between the input terminal and an input port of the level shifter;

a first control switch and a second resistor connected in series between the input port of the level shifter and a ground voltage line; and a second control switch connected in parallel to the first resistor, the second control switch being driven alternatively with the first control switch.

10. The method of claim 9, wherein the shift register and the level shifter are fabricated to include in an integrated circuit chip.

11. The method of claim 9, wherein the shift register, the voltage controller and the level shifter are fabricated to include in an integrated circuit chip.

* * * * *